United States Patent [19]

Watanabe et al.

[11] Patent Number: 5,008,704

[45] Date of Patent: Apr. 16, 1991

[54] METHOD OF FORMING ORIGINAL IMAGE AND ADDITIONAL IMAGE, AND APPARATUS FOR PERFORMING SAME

[75] Inventors: Junji Watanabe, Yokohama; Yuji Ishikawa, Tokyo, both of Japan

[73] Assignee: Kabushiki Kaisha Toshiba, Kawasaki, Japan

[21] Appl. No.: 337,738

[22] Filed: Apr. 13, 1989

[30] Foreign Application Priority Data

Apr. 15, 1988 [JP] Japan ..... 63-93106

[51] Int. Cl.[5] ..... G03G 15/00

[52] U.S. Cl. ..... 355/202; 355/203; 355/218

[58] Field of Search ..... 355/202, 203, 218, 244, 355/271

[56] References Cited

U.S. PATENT DOCUMENTS

| | | | |
|---|---|---|---|
| 4,340,295 | 7/1982 | Nakamura | 355/202 |
| 4,640,601 | 2/1987 | Deguchi et al. | 355/218 |
| 4,707,109 | 11/1987 | Kanno et al. | 355/218 |
| 4,761,673 | 8/1988 | Watanabe et al. | 355/218 X |
| 4,794,421 | 12/1988 | Stoudt et al. | 355/202 |

FOREIGN PATENT DOCUMENTS

| | | |
|---|---|---|
| 3020687 | 12/1980 | Fed. Rep. of Germany . |
| 58-217378 | 12/1983 | Japan . |

OTHER PUBLICATIONS

T. J. Harris, "Optical Printer", IBM Technical Disclosure Bulletin, vol. 13, No. 12, May 1972, pp. 3757-3758.

*Primary Examiner*—Arthur C. Prescott
*Attorney, Agent, or Firm*—Foley & Lardner

[57] ABSTRACT

In an electronic copying machine, a picture on an original is optically scanned by an optical system including a first carriage provided with an exposure lamp. An image obtained by the optical system is formed on the surface of a tubular-shaped photoconductive drum rotating in a predetermined direction. Additional pictorial information such as a date or a telephone number, which is not included on the original picture, is written at a desired location on the original image. Such additional information is entered into the copying machine from an operational panel of the machine. The light from the optical system led to the drum is partially shut off by a shutter. A character generator generates pattern data corresponding to the entered additional information, the pattern data being written in at the location on the drum surface which is shielded from the incident light by the shutter. A write unit is used for the writing of the pattern data. The original image and the pattern data formed onto the drum surface are developed and transferred on a recording paper.

24 Claims, 22 Drawing Sheets

METHOD OF FORMING ORIGINAL IMAGE AND ADDITIONAL IMAGE, AND APPARATUS FOR PERFORMING SAME

BACKGROUND OF THE INVENTION

1. Field of the Invention

The present invention relates to an image forming apparatus with a character-writing function, and to a method of performing this function. More particularly, the present invention relates to an image forming apparatus capable of copying an original image and of writing characters, and to a method of performing the character writing.

2. Description of the Related Art

Recently, an electronic copying machine has been developed in which the pictorial information including characters that are different from a copied original image is written on a paper as a recording medium. The recording paper having an original image copied therein is led to an image forming section. Another image such as characters is formed on the recording paper bearing the original image in the image forming section. Thus, the above electronic copying machine requires two steps for the image formation, a step of forming an original image and a step of forming another image. Accordingly, the image forming speed of the copying machine is slow, compared to the corresponding image forming speed of the one-step image formation. Further, it is difficult to exactly position the image written after the original image is copied.

There has been developed another type of copying machine of the type in which an image is read from an original and the image data is then converted into electrical signals, and the original image is reproduced by using the converted electrical signals. This type of copying machine is called a digital copying machine. In the case of the digital copying machine, for example, a laser printer, the additional image including characters can be written on the recording paper while an original image is being copied. However, the digital copying machine is more expensive than the ordinary electronic copying machine.

SUMMARY OF THE INVENTION

Accordingly, it is an object of the present invention to provide an image forming apparatus which is capable of copying an original image and of writing an additional image including characters onto a desired location on the original image.

Another object of the present invention is to provide a method of writing an additional image including characters onto a desired location on an original image.

According to an aspect of the present invention, there is provided an image forming apparatus for forming an image identical to an original image and a specific pattern image, both on a moving image carrier comprising means for entering data representing the specific pattern image, means for generating pattern data corresponding to the data entered by the entering means, means for forming the image corresponding to the original image on the image carrier, means, movable along the image carrier in a direction which is orthogonal to the direction in which the image carrier moves, for forming the pattern image corresponding to the pattern data generated by the pattern data generating means on the image carrier, means for making visible the image and the pattern data which are formed on the image carrier.

According to another aspect of the present invention, there is provided an electronic copying machine comprising means for entering desired write data, means for generating pattern data corresponding to the write data entered by the entering means, means for optically scanning an original image in a first direction and for forming the image corresponding to the original image on the image carrier, means, movable along the image carrier in a second direction which is orthogonal to the first direction, for writing the pattern data generated by the pattern data generating means at a location on the image carrier, means for developing the image and the pattern data which are formed on the image carrier, means for transferring onto a recording medium the image and the pattern data developed by the developing means, and means for fixing the image and the pattern data transferred onto the recording medium by the transfer means.

According to still another aspect of the present invention, there is provided a method of forming an original image and desired additional image onto a recording medium, comprising the steps of entering desired write data, generating pattern data corresponding to the write data entered by the entering means, optically scanning an original image in a first direction, forming on an image carrier an image corresponding to the original image scanned in the scanning step, shielding the image carrier from a light from the original image in response to a write command of the write data, writing the pattern data on the image carrier shielded in the shielding step, and making visible the image and the pattern data which are formed on the image carrier.

BRIEF DESCRIPTION OF THE DRAWINGS

The aforementioned aspects and other features of the present invention are explained in the following description, taken in connection with the accompanying drawings, in which.

DETAILED DESCRIPTION OF THE PREFERRED EMBODIMENTS

An embodiment of an image forming apparatus according to an embodiment of the present invention will be described with reference to the accompanying drawings.

Figure 1:
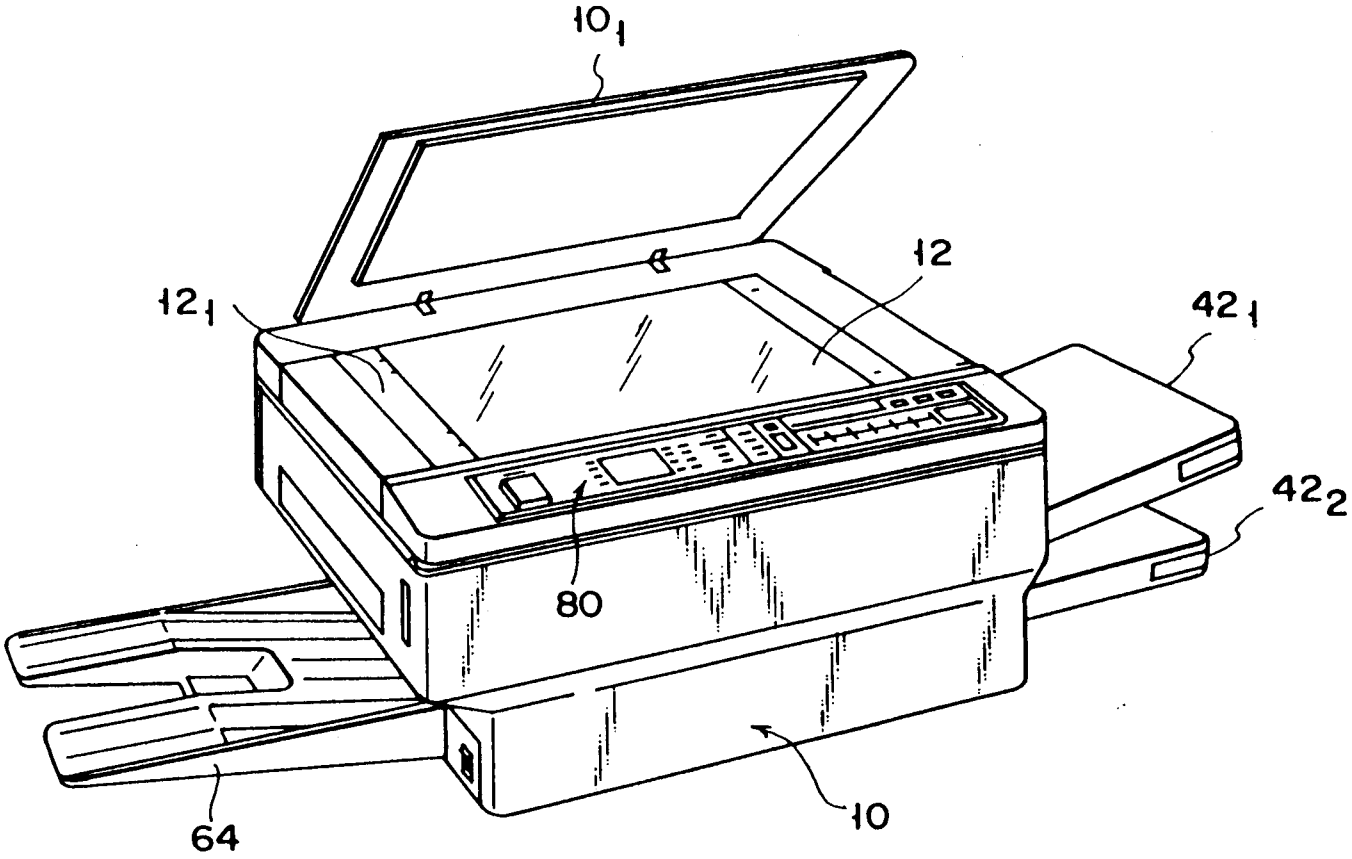
FIG. 1 shows a perspective view of an image forming apparatus according to the present invention.
Figure 2:
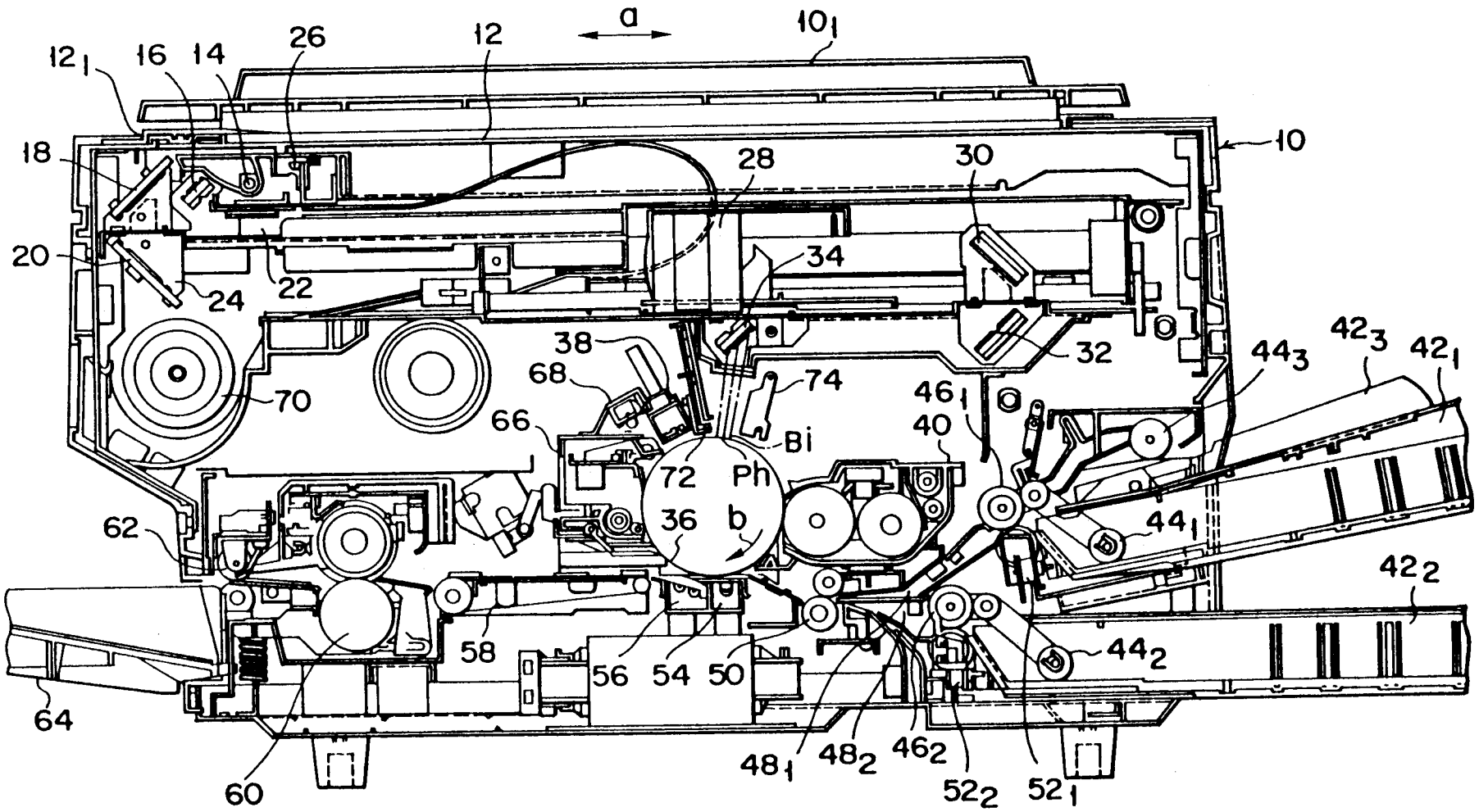
FIG. 2 shows a longitudinal sectional view of the image apparatus shown in FIG. 1.

FIGS. 1 and 2 schematically illustrate a mechanical configuration of an image forming apparatus, e.g., a copying machine, according to the present invention. A main body 10 of the copying machine is provided with an original table (transparent glass) 12. The table 12 to support an original is fixed on the top of the main body 10. The table 12 includes a fixed scale $12_1$, which provides a reference when an original is set thereon. A cover $10_1$ is hinged at one side of the top of the main body for open and close.

An optical system including an exposure lamp 14, and mirrors 16, 18 and 20 is reciprocatively movable in the direction of arrow "a", under the original table 12. An original set on the table 12 is optically scanned through the reciprocal operation of the optical system. The exposure lamp 14 and the mirror 16 are carried on a first carriage 22, while the mirrors 18 and 20 are carried, on a second carriage 24. To maintain a predetermined optical length for exposure, the second carriage 24 moves at the half speed of the first carriage 22. The first carriage 22 is provided with a spot light source 26 (to be described later in detail). The light source 26 is movable in the direction orthogonal to the moving direction of the first carriage 22. The light source 26 is provided with a light emitting element for emitting a spot light toward the original table 12. The spot light is used for designating an erasure area, for example, on an original.

A reflected light from the original, which results from the scanning operation by the optical system, viz., the light reflected from the original when it is illuminated by the exposure lamp 14, is reflected by the mirrors 16, 18 and 20 in a successive order, passed through a lens block 28 for varying a magnification, reflected again by mirrors 30, 32 and 34, and finally directed to a photoconductive drum 36, in the form of an incident light Bi. With the incident light Bi, an image on the original is formed on the surface of the photoconductive drum 36.

With rotation of the drum 36 in the direction of arrow "b", the drum surface reaches under a main charger 38 where it is charged, and is subjected to a light exposure in an exposure section Ph, so that a latent image corresponding to the original image is formed on the charged drum surface. With a further progression of the drum rotation, the latent image electrostatically attracts a toner supplied from a developing unit 40, so that it is visualized. The developing unit 40 is removably attached to the main body 10 of the copying machine. The side wall of the developing unit 40 is appropriately marked with code information (not shown) representing a color of the toner contained. A sensor mounted to the main body 10 senses the code information for recognition of a color of the toner.

In this instance, recording papers of two different sizes are used as recording medium, and are contained in two types of cassettes, an upper cassette $42_1$ and a lower cassette $42_2$. Either cassette may be selected with a cassette select key on an operation panel to be given later. A stack of recording papers are contained in each of those cassettes $42_1$ and $42_2$, and picked up by a pick-up roller $44_1$ or $44_2$ and fed forward by a feed roller pair $46_1$ or $46_2$. The paper is then guided through a paper guide path $48_1$ or $48_2$ and transported to a register roller pair 50. This register roller pair 50 further transports the paper to a transfer section. The cassettes $42_1$ and $42_2$ are removably attached to the lower right side of the main body 10. Switches $52_1$ and $52_2$, which are provided in association with the cassettes $42_1$ and $42_2$, respectively, detect the sizes of the cassettes. These switches $52_1$ and 22 are each constructed with a plurality of micro-switches that are turn on and off when the cassette is set to the main body 10. Additionally, a manual guide $42_3$ is further provided above the upper surface of the cassette $42_1$. A paper is manually set to the manual guide $42_3$ is guided to the feed roller pair $46_1$ by a manual feed roller $44_3$, and subsequently is transported to the transfer section through the same route as that for the cassette $42_1$.

In the transfer section, the paper is in close contact with the surface of the photoconductive drum 36 under a transfer charger 54, so that the transfer charger 54 acts on the toner image on the drum surface to transfer it onto the paper thereunder. Further, a separation charger 56 operates to electrostatically separate the paper with the transferred image from the photoconductive drum 36. The separated paper is then transported to a fixing roller 60 constituting a fixing unit, by means of a transfer belt 58. After the recording paper bearing the fixed image passes through the fixing unit, the transferred image is fixed on the paper. The paper emanating from the fixing unit is discharged into a receiving tray 64 outside the main body 10, by means of an exit roller pair 62.

After transferring the toner image onto the paper, the photoconductive drum 36 further moves under a cleaner unit 66. In this place, the residual toner still left on the drum surface is removed and the drum surface is restored to its original state. A cooling fan 70 is provided for preventing an excessive rise of temperature within the main body 10.

Around the photoconductive drum 36, an erase array 72 is further located between the main charger 38 and the exposure section Ph. The erase array 72, which is for partially erasing a part of an original image, contains a plurality of light emitting elements (LEDs) arrayed extending in the longitudinal direction of the drum 36. In the partial erasing operation, the LED array is lit on and emits a light toward an erasure area as specified by the spot light source 26, to remove the charge in the specified drum surface area. In the subsequent latent image forming process to be performed in the exposure section Ph, no latent image, therefore, is formed in the specified area. Consequently, this part of the original image will be erased.

A writing unit 74 is additionally disposed between the exposure section Ph and the developer 40. The writing unit 74 writes another item of pictorial information such as characters onto a recording paper when the copying operation of an original image progresses. The details of the writing unit 74 will be described later.

Figure 3:
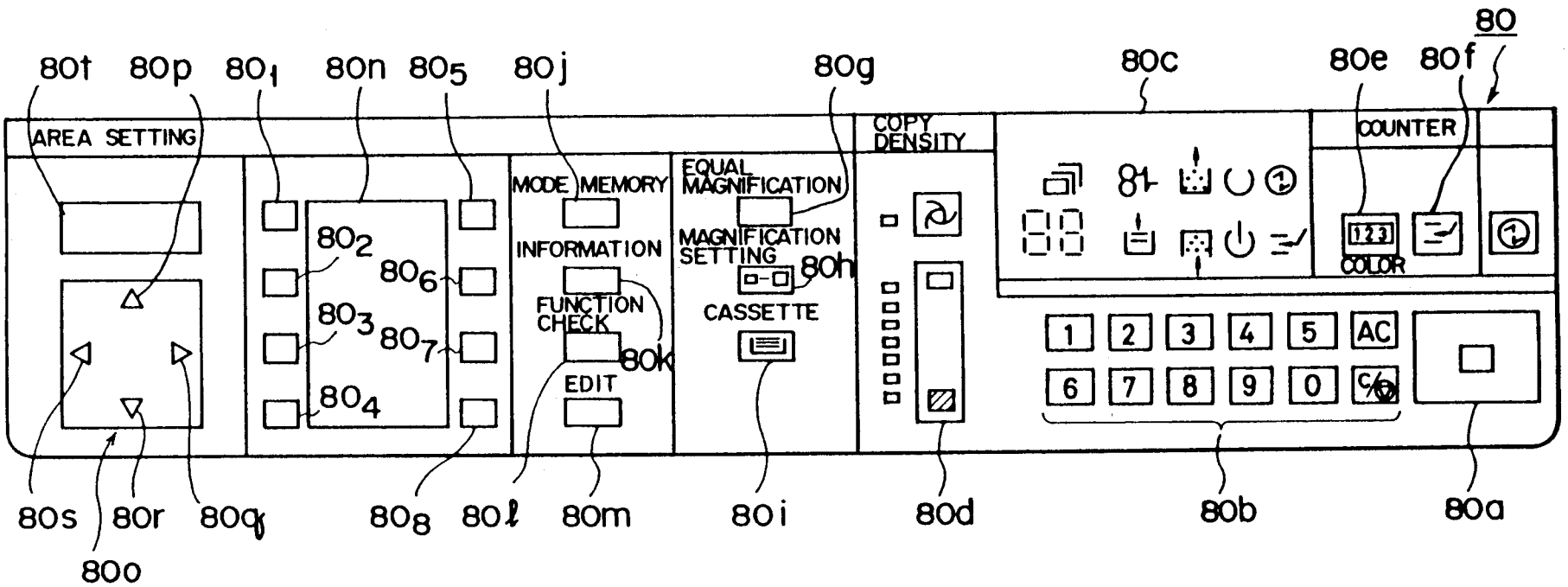
FIG. 3 shows a plan view of an operation panel of the image forming apparatus of FIG. 1, in which various keys, indicators and the like are laid out.

FIG. 3 shows an operational panel 80 disposed on the top of the main body 10 of the copying machine (FIG. 1). In the figure, reference numeral 80*a* designates a start key for starting up the copying operation of the copying machine; 80*b*, a set of ten keys for setting the number of copies, for example; 80*c* an indicating section for indicating operating states of the machine, paper jamming and the like; 80*d*, a density setting section for setting a desired optical density of the copied image; 80*e*, a count command key for providing a display of a total number of copies and the number of copies for each color; 80*f*, an interrupt key for an interrupt copy; 80*g*, a 100%-magnification key for setting a copy magnification at 100%; 80*h*, a magnification key for setting a desired copy magnification; and 80*i*, a cassette select key for selecting either of the upper and lower cassettes $42_1$ and $42_2$. A mode memory key 80*j* is used in such a way that when an area on an original to be erased is designated by an edition key 80*m* to be described later, the mode memory key is operated to store this erasure area into a memory and the same is used to read out the data concerning an erasure area prestored in the memory. An information key 80*k* is operated when the information in connection with each mode is desired. For example, when a paper jamming occurs, this key 80*k* is operated, so that an operator sees the information concerning the removal of the jamming that are displayed in a display window 80*n*. A function key 80*l* is used when an operator desires to see what function has been set in the copying machine. The function is displayed in the display window 80*n*. The edition key 80*m* is used for erasing a part of an original image to be copied. The display window 80*n* is constructed with a liquid crystal dot-matrix panel, for example. When any of those keys 80*e*, 80*f*, and 80*g* to 80*m* is operated, the window 80*n* displays the contents related to the operated key. Two groups of keys $80_1$ to $80_4$ and $80_5$ to $80_8$ are disposed on both sides of the display window $80_n$. Those keys $80_1$ to $80_8$ are each used to select various functions displayed in the display window $80_n$. A movement key $80_o$ is used for moving the spot light source 26 in four different directions of arrows $80_p$ to $80_s$. The spot light source 26 may be moved in the same direction as that indicated by each arrow head $80_p$ to $80_s$. $80_t$ designates a location designation key to enter the coordinates as indicated by the spot light source 26.

Figure 4:
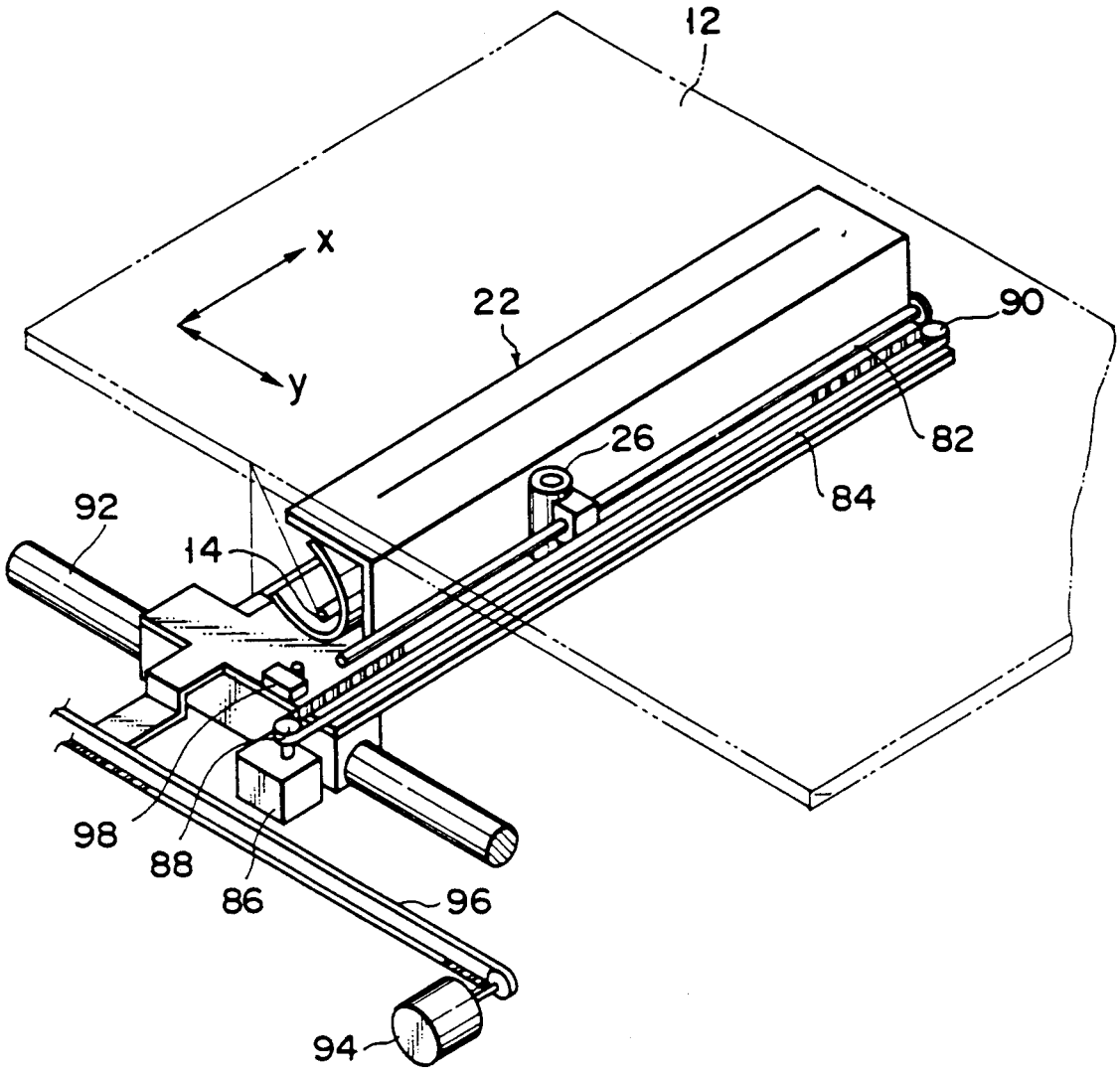
FIG. 4 shows a perspective view of a structure including a spot light source, which is contained in the image forming apparatus of FIG. 1.

An erasure means for erasing a part of an original image will be described with reference to FIG. 4.

In the Figure, the first carriage 22 is provided with a guide shaft 82, which is located in a portion of the carrier shielded from the light from the exposure lamp 14, and extends along the exposure lamp 14. The spot light source 26, confronting the original table 12, includes a light emitting element such as a light emitting diode or a lamp, and a lens for transforming the light emitted from the light emitting element into a spot light toward the table 12. The spot light has such an intensity as to transmit an original of a thickness comparable with that of a postcard. The spot light source 26 is coupled with a timing belt (belt with teeth) arranged along with a guide shaft 82. The timing belt 84 is wound around a pulley 88 and a follower pulley 90. The pulley 86 is coupled with a rotary shaft of a stepping motor 88 for driving the light source. With such a structure, with rotation of the stepping motor 86, the spot light source 26 is moved in a main scanning direction orthogonal to the scanning direction of the first carriage 22. The vertical scanning direction is the direction of arrow "x" in FIG. 4.

The first carriage 22 is guided by a guide rail 92 provided on the side of the first carriage 22 on which the stepping motor 86 is installed. A drive force of the stepping motor 94 for driving the first carriage 22 is transferred through an endless belt 96 to the first carriage 22, which in turn is driven in the direction of arrow "y". A position sensor 98 is provided at the end of the first carriage 22 near which the stepping motor 86 is located. The position sensor 98 is for detecting an initial position of the light source 26 and is constructed with a microswitch.

Figure 5:
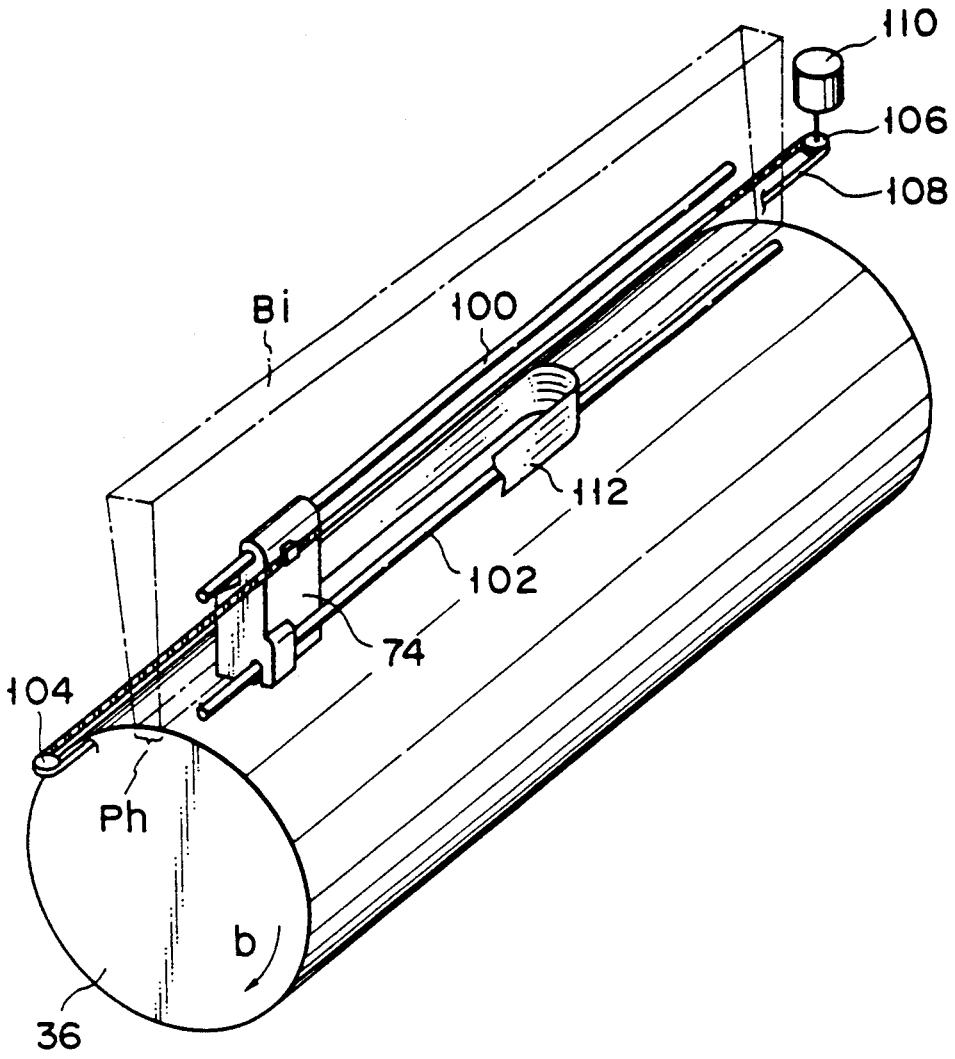
FIG. 5 shows a perspective view of a structure containing a writing unit that is essential to the present invention.

FIG. 5 illustrates the writing unit 74 and its peripheral portion. The writing unit 74 is movably coupled with guide shafts 100 and 102, which are arranged in the longitudinal direction of the photoconductive drum 36, and slidably moves along these shafts. Pulleys 104 and 106 are disposed near the respective ends of these guide shafts. A timing belt 108 to which the writing unit 74 is fixed is wound around the pulleys 104 and 106. The pulley 106 is coupled with by a stepping motor 110 for driving the writing unit 74. When the motor 110 is driven, the pulley 106 and the timing belt 108 are driven to move the writing unit 74 along the drum 36. The writing unit 74 is coupled with a flat cable 112, and receives an electrical signal through the flat cable 112 from a LED driver unit (not shown).

Figure 6:
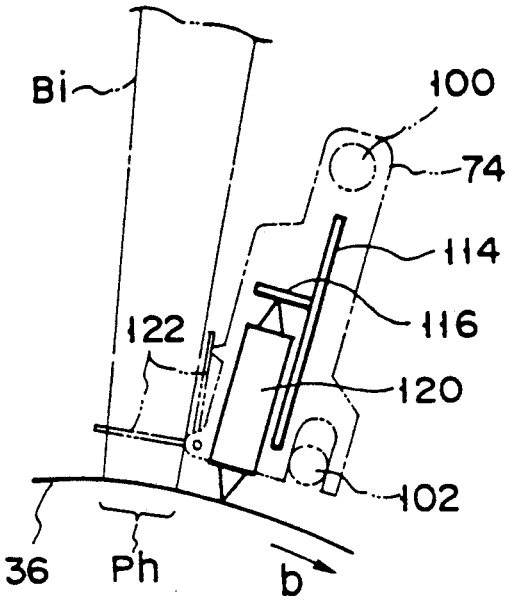
FIG. 6 shows a side view of a major part of the writing unit.
Figure 7:
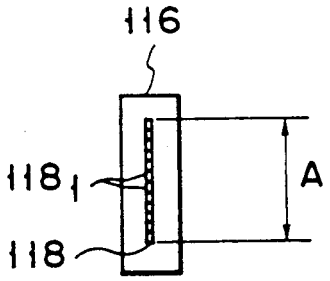
FIG. 7 shows a plan view of an LED array.

FIG. 6 shows a configuration of the writing unit 74. A printed circuit board (PCB) 114 is mounted in the writing unit 74. The PCB 114 is coupled with a sub-board 116 oriented orthogonal to the PCB 114. The sub-board 116 contains a light emitting diode (LED) array 118 which faces the photoconductive drum 36, as shown in FIG. 7. The LED array 118 consists of a plurality of LEDs $118_1$ arrayed in the longitudinal direction of the drum 36. The length A of the LED array 118 is selected to be shorter than the half of the maximum copying width on the drum 36. The LED elements of array 118 are selectively turned on, on the basis of a signal (corresponding to a character or the like) which is supplied, through flat cable 112 connected to PCB 114, from an LED driving section to be mentioned later. The writing unit 74 further contains a focusing light lens 120 for guiding a light emitted from the LED array 118 to the surface of the photoconductive drum 36. A shutter 122 is provided on the side wall of the writing unit 74. The shutter 122 shuts off a part of a light Bi which is incident on the drum 36 corresponding to the LED array 118. When a character, for example, is written on the drum surface with the LED array 122, the shutter 122 shuts off the incident light corresponding to the area on which the character is to be written, so as to prevent the charge in that area of the drum surface from being erased by the incident light.

Figure 8:
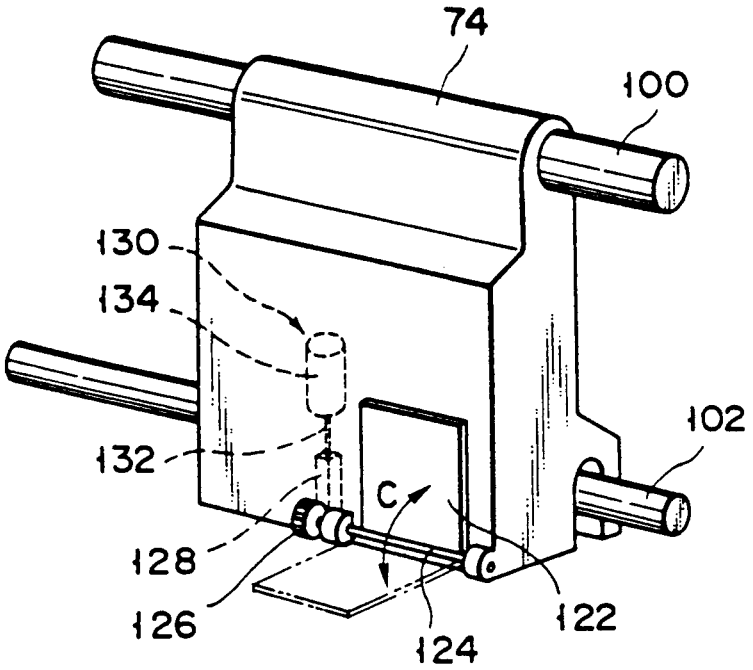
FIG. 8 shows a perspective view of a shutter of the writing unit.
Figure 9:
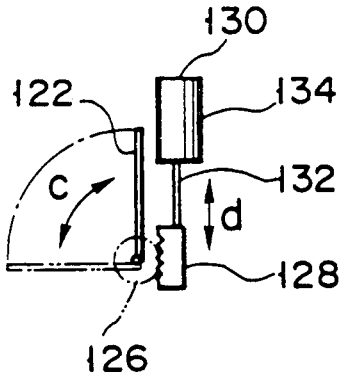
FIG. 9 is a side view showing the relationship of the shutter and the solenoid plunger.

FIGS. 8 and 9 show a structure of the shutter 122 and its peripheral portion. The shutter 122 is swingable about a shaft 124 in the direction of arrow "c". At the one end of the shaft 124, a pinion 126 is in mesh with a rack 128 that is located inside the writing unit 74. Inside the writing unit 74, the rack 128 is coupled with a solenoid plunger 130. With the reciprocal motion of the plunger 132 in the direction "d" (FIG. 9), the shutter 122 swings in the direction "c" to open and close, through the rack and pinion mechanism. More specifically, a solenoid 134 with the plunger 132 is normally in a de-energized state. In this state, the plunger 132 is pushed out by a spring (not shown). The shutter 122 is in an open state to allow the incident light Bi to pass toward the surface of the photoconductive drum 36. In the open state, of the shutter 122 (indicated by a solid line) stands beside the side wall of the writing unit 74. When the solenoid 134 is energized, the plunger 132 is retracted into the solenoid 134. The shutter 122 is swung to close to shut off part of the incident light Bi, as indicated by dotted lines.

Figure 10:
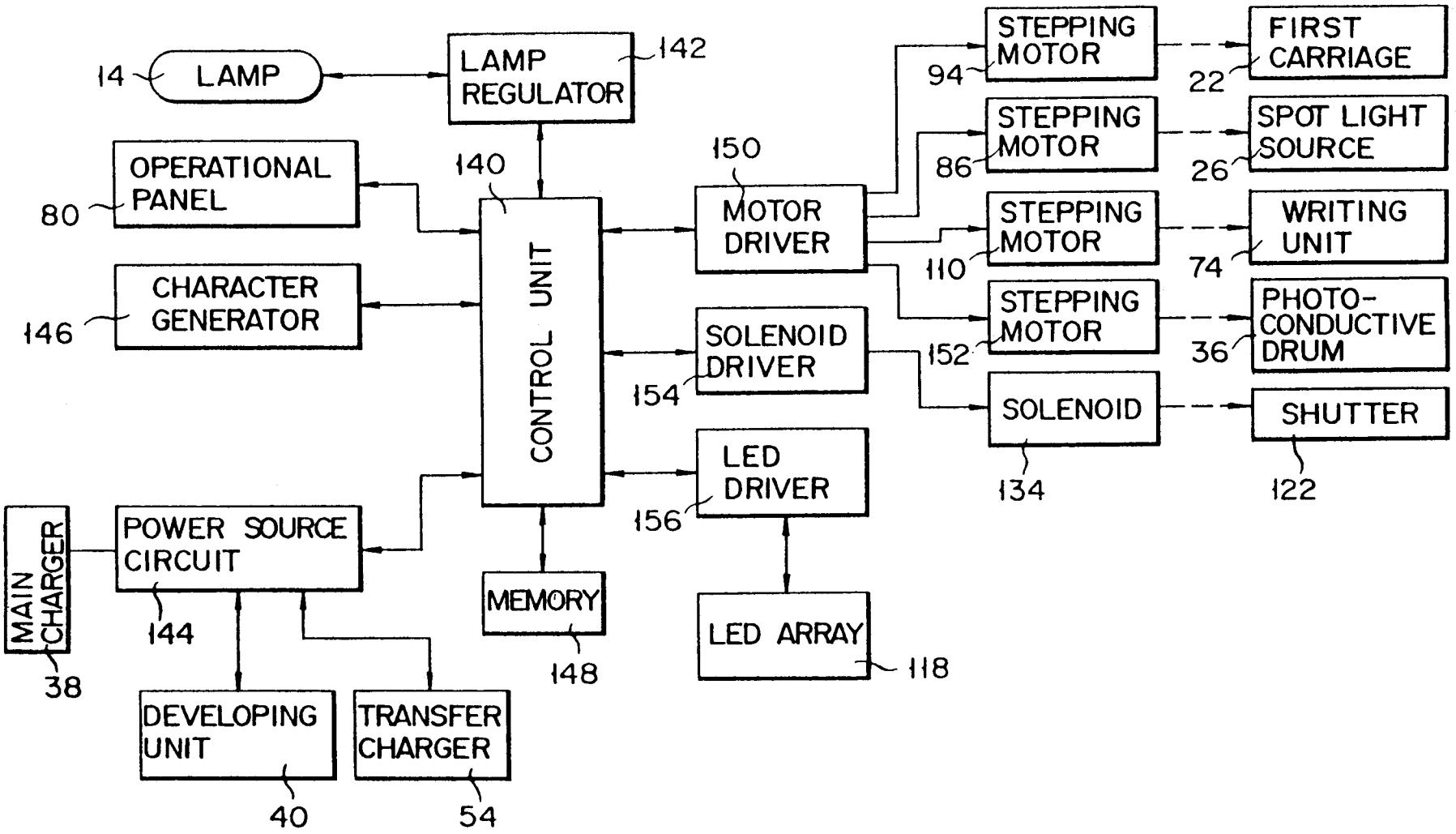
FIG. 10 is a block diagram showing a control system of the image forming apparatus of FIG. 1.

FIG. 10 shows a configuration of a major part of a control system of the copying machine. In the Figure, a control unit 140 is for an overall control of the copying machine. The control unit 140 is coupled with a lamp regulator 142 for regulating the exposure lamp 14, a power source circuit 144 for supplying electric power to the main charger 38, developing unit 40 and transfer charger 54 and the like, and the operation panel 80. Further, the control unit 140 is coupled with a character generator 146 for generating characters formed of a number of dots in accordance with characters entered from the operation panel 80, and a memory 148 storing an operation program and the like for the control unit 140. A motor driver 150 is also coupled with the control unit 140. The motor driver 150 is for driving various types of stepping motors; the stepping motor 152 for driving the photoconductive drum 36, stepping motor 86 for driving the spot light source 26, stepping motor 94 for driving the first carriage 22, and stepping motor 110 for driving the writing unit 74. The control unit 140 is additionally coupled with a solenoid driver 154 for energizing and de-energizing the solenoid 134 to open and close the shutter 122, and a LED driver 156 for lighting on the LED array 118 in accordance with a character signal supplied from the character generator 146.

A description follows for an image formed on the surface of the photoconductive drum 36 by the LED array 118 and the incident light Bi partially shut off by the shutter 122.

Figure 11:
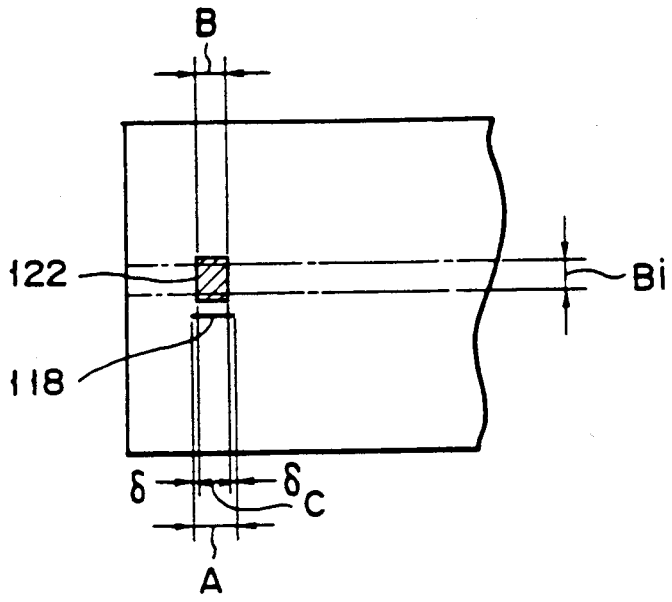
FIG. 11 is a plan view showing an incident light and the shutter.
Figure 12:
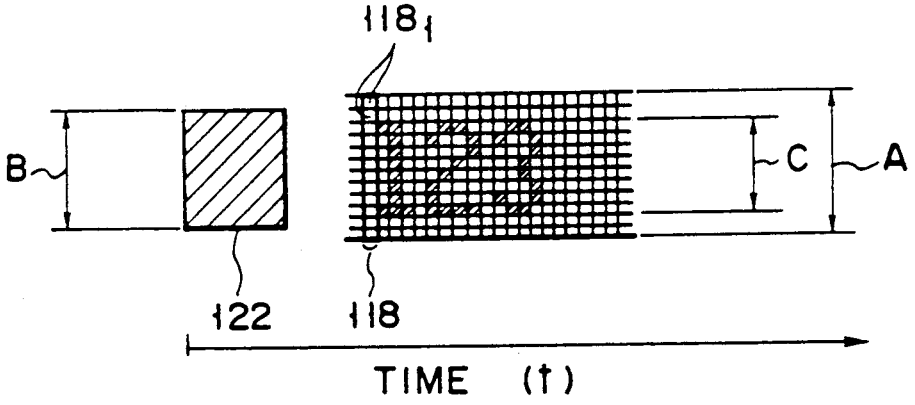
FIG. 12 is a view showing a relationship of the shutter and the LED array when the writing of a character is performed.

As shown in FIGS. 11 and 12, a length A of the LED array 118 is longer than a width B of the shutter 122 by 2 delta ($\delta$). The shutter 122 is disposed with respect to the LED array 118 in such a way that both sides of the shutter are spaced each by delta ($\delta$) from the corresponding sides of the LED array. The reason for this follows.

Let us assume now that the width B of the shutter 122 is equal or shorter than the length A of the LED array 118. When the shutter 122 shuts off part of the incident light Bi, the width of the residual charges on the drum 36 is longer than the length A of the LED array 118. Therefore, when the LED array 118 is lit on, it cannot erase the residual charges in an area amounting to the difference between them. After development, that area is left black. More exactly, the portions corresponding to both ends of the LED array 118 become black stripes after development.

Figure 13:
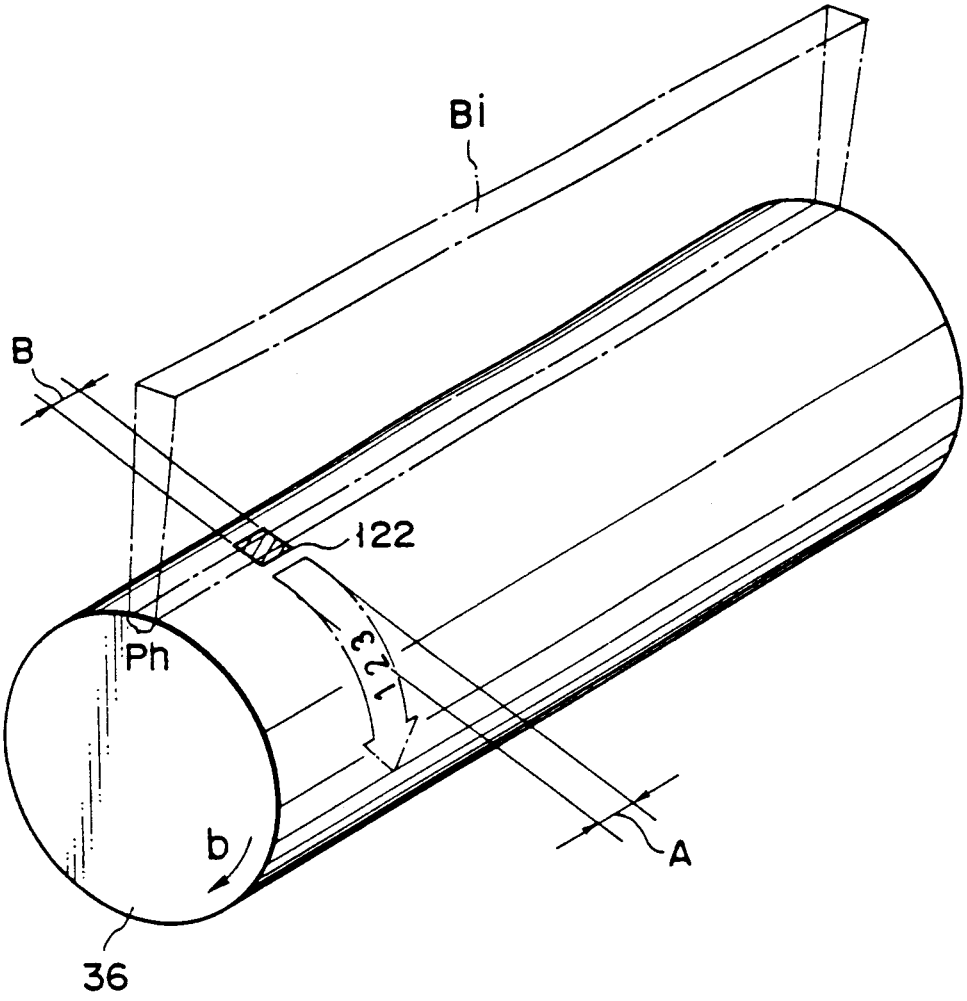
FIG. 13 is a perspective view showing a developed image on a photoconductive drum.

It is for this reason that the length A of the LED array 118 is longer than the width B of the shutter 122 and those are disposed as mentioned above. In operation, the LED elements $118_1$ of the LED array 118 are selectively lit off in accordance with a figure of a character to be written, while the remaining elements remain lit on. A width C of a character is narrower than the width B of the shutter 122. Within the character width C, a portion on the drum surface corresponding to the LED elements $118_1$ lit off remains charged. After development, characters appear as shown in FIG. 13. In this instance, the LED array 118 consists of on linear array of LED elements $118_1$. To form character images, these LED elements $118_1$ of the linear LED array 118 are selectively lit on while the LED array 118 being moved to the right as viewed in the drawing (see FIG. 13). The LED elements $118_1$ at both end portions of the LED array 118 are always lit on. The charges in the portion of the drum surface corresponding to those end portions are removed, so that the unnecessary black stripes will never appear at the portion corresponding to both the sides of the shutter 122.

Figure 14:
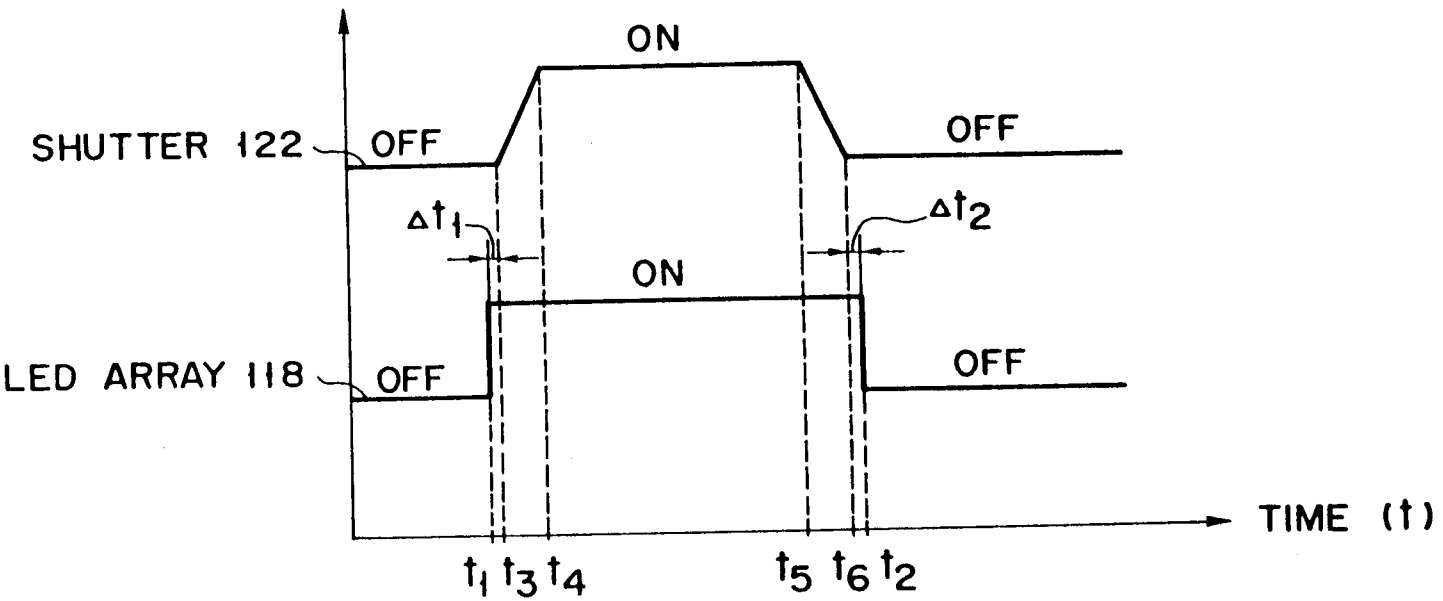
FIG. 14 is a timing chart showing a relationship among the timing of a shutter operation, and on- and off-timings of a LED array.
Figure 15A:
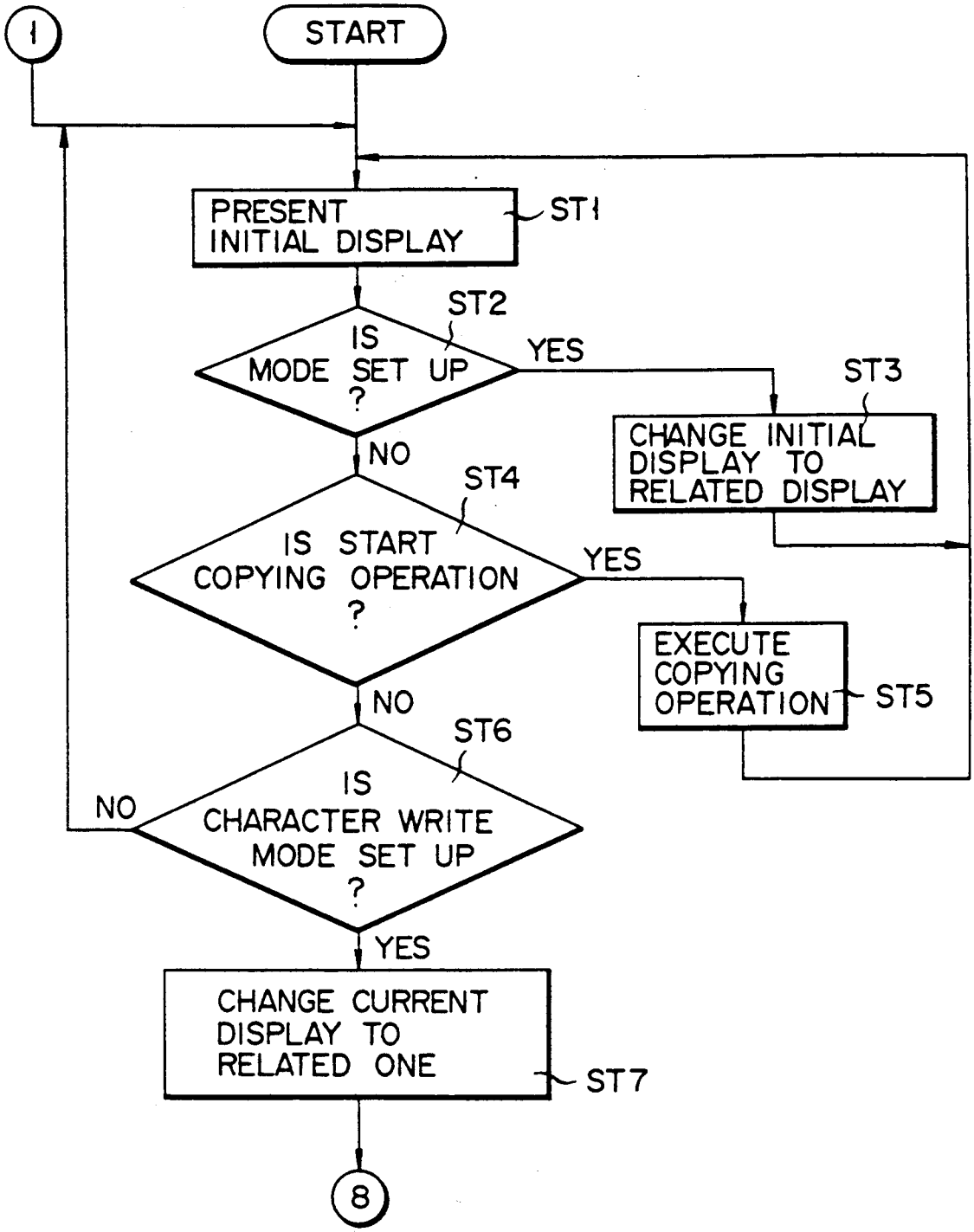
FIGS. 15A through 15F are flowcharts for explaining operations of the image forming apparatus.
Figure 15B:
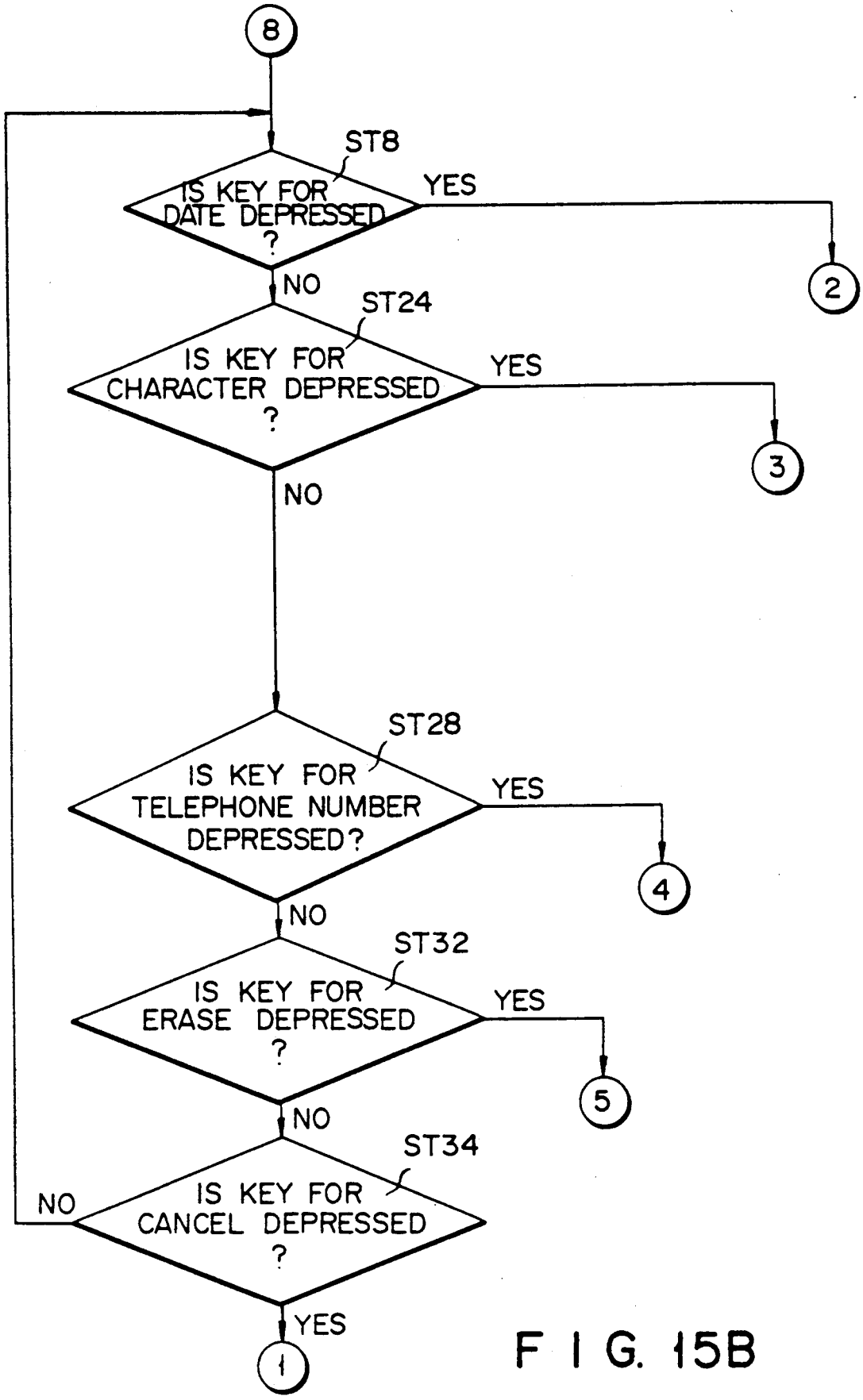
Figure 15C:
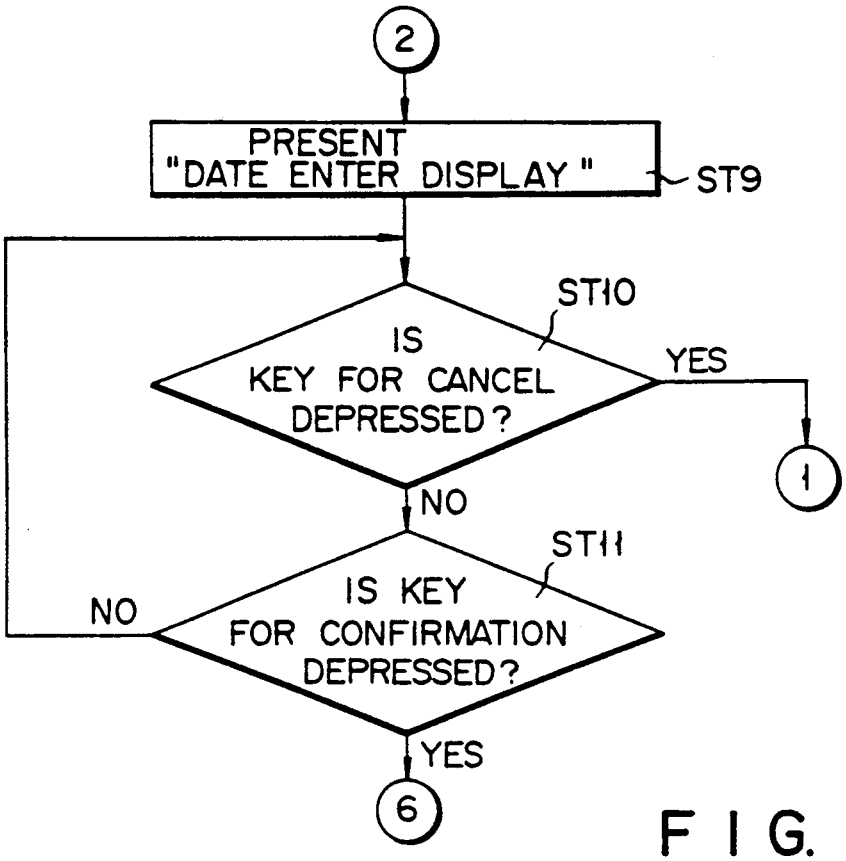
Figure 15D:
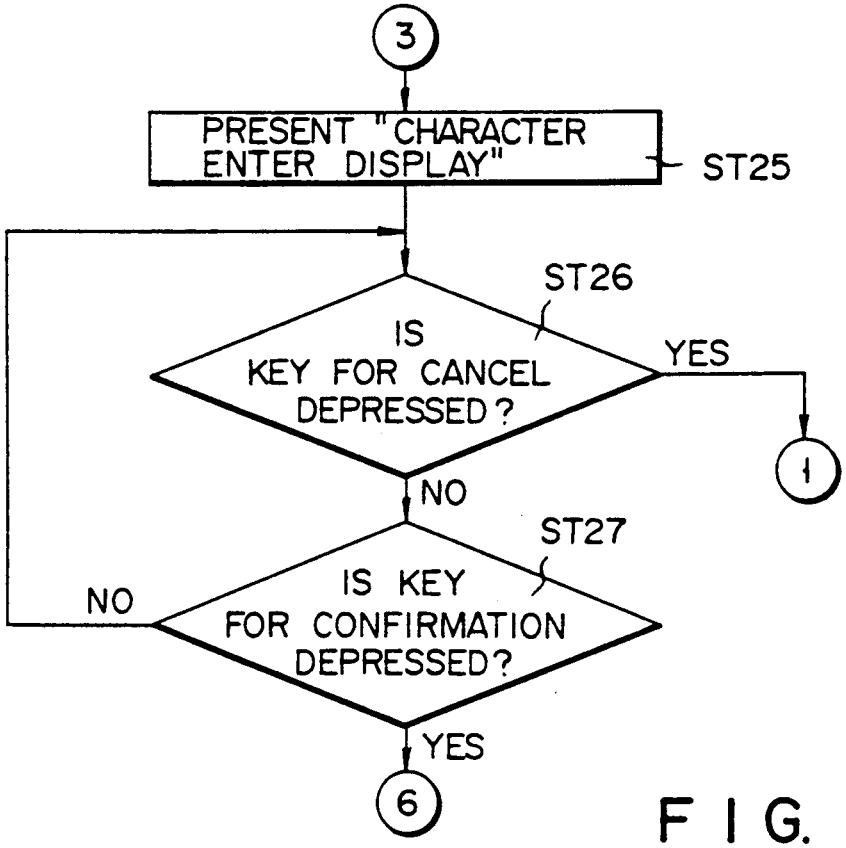
Figure 15E:
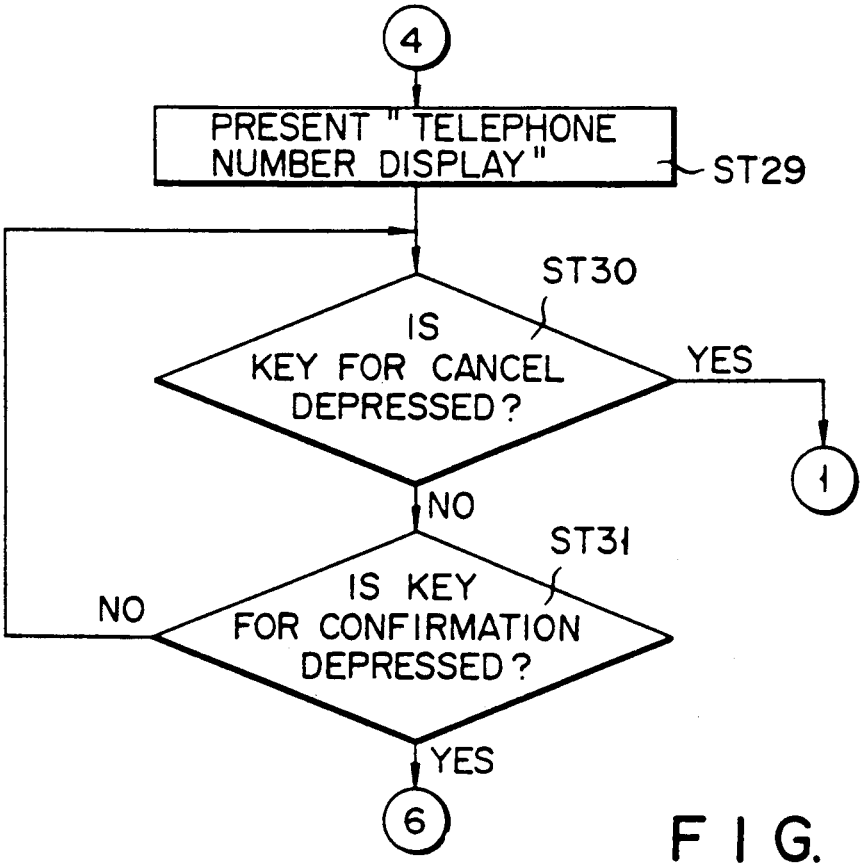
Figure 15F:
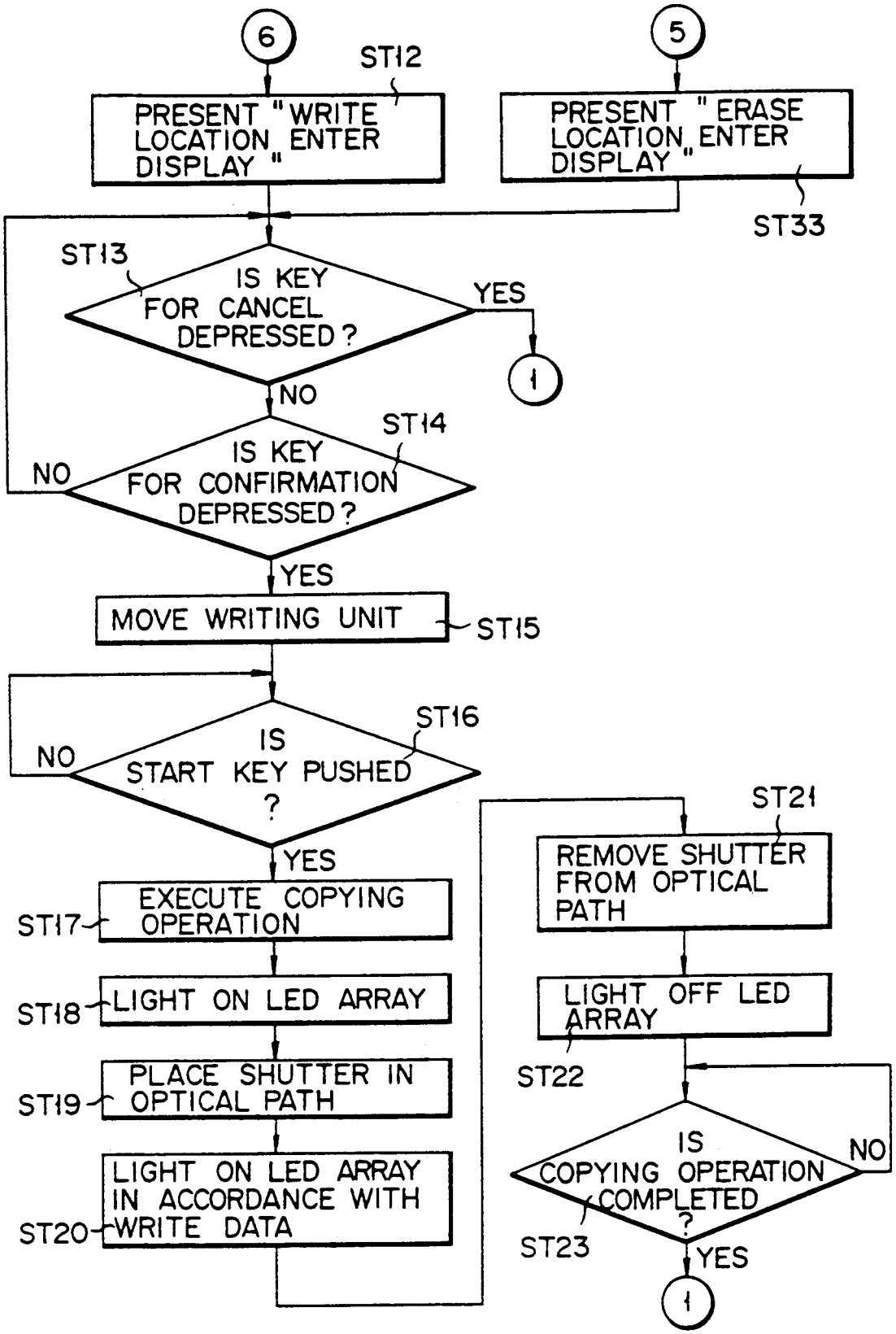

As shown in FIG. 12, the shutter 122 is located upstream of the LED array 118 as viewed in the rotating direction "b" of the photoconductive drum 36. Accordingly, if an improper relationship is set up between a shutter timing of the shutter 122 and a timing of light-on of the LED array 118, an image at a portion corresponding to the leading end of the shutter 122 is left, not erased. To avoid this, these timings are selected as shown in FIG. 14.

To write a character, for example, in a copied image, the LED array 118 is lit on at time $t_1$, and lit off at time $t_2$. The shutter 122 starts to swing at time $t_3$ delayed by $\Delta t_1$ behind time $t_1$, and enters the incident light Bi. At time $t_4$, the shutter 122 is fully swung. After completion of writing the character, the shutter 122 starts to swing in the reverse direction at time $t_5$, and is fully swung at time $t_6$ to close. After $\Delta t_2$ elapses from time $t_6$, i.e., time $t_2$, the LED array 118 lights off.

The on-off timings of the shutter 122 and LED array 118 eliminates the above fail-to-erase problem.

The operation of the copying machine thus arranged will be described with reference to FIGS. 15A through 15F showing a set of flowcharts and FIGS. 16A through 16G showing the display window **80*n*** and its related keys.

In a normal stand-by mode of the copying machine, the display window **80*n* disposed on the operational panel 80 provides an initial display containing initially set items; "100%" for magnification, "A4" for paper size, and "Character write" for write mode select (step ST1). In the stand-by mode attendant with the initial display, if any of other keys of those 80*g* to 80*i*, and 80*j* to 80*m* on the operational panel 80 are operated (step ST2), the contents in the display window 80*n*** are changed to those as specified by the key operated, and the copying machine allows one to set up a desired mode (step ST3).

In this condition, if the start key **80*a* is depressed (step ST4), the copying machine performs a copying operation at the set magnification and by using recording papers of the set size (step ST5). Specifically, the first and second carriages 22 and 24 are moved in the main scanning direction (the direction "a" in FIG. 1), and at the same time the exposure lamp 14 illuminates a recording paper on the original table 12. A light containing the pictorial information of a picture on the original is reflected from the original, and directed to the mirrors 16, 18 and 22. The light is reflected by those mirrors, and directed through the magnification varying lens block 28 toward the mirrors 30, 32 and 34. The light is reflected against those mirrors. The reflected light is directed to the photoconductive drum 36 whose surface has been charged, and arrives at an exposure portion Ph of the drum surface to form an electrostatic latent image on the portion Ph. The latent image is developed with a toner supplied from the developing unit 40. The transfer charger 54 transfers the toner image onto a recording paper of A4 size as is supplied from the cassette $42_1$ or $42_2$, or the manual guide $42_3$, and transported through the guide paths $48_1$, or $48_2$. Afterward, the separation charger 56 separates the paper from the photoconductive drum 36. The fixing unit fixes the transferred toner image with its heat roller 60, and discharges the paper bearing the fixed image into the receiving tray 64. The residual toner on the photoconductive drum 36 is removed by the cleaner 66, and the drum surface is discharged by the discharge lamp 68**. In this way, the original image is copied on a sheet of recording paper.

In step ST4, when the start key 80*a* is not operated, and the key $80_4$ to set up the character write mode is depressed, the character write mode is set up (step ST6). In this mode, the contents of the window 80*n* (FIG. 16A) is switched as shown in FIG. 16B (step ST7). As shown, the displayed items in the display window 80*n* of FIG. 16B are: "Date", "Character", "Phone No.", "Erase", and "Cancel". When a key $80_1$ associated with "Date" is depressed, an operator may write date on the copied paper. Likewise, when a key $80_2$ for "Character" is operated, a character may be written. Operating the related key for "Erase" allows an operator to designate a portion of an image to be erased. When a key $80_8$ for "Cancel" is operated, the display window 80*n* contents is returned to the initial ones shown in FIG. 16A. In any other displays, the key $80_8$ similarly functions and returns the current display to the initial display.

The operation of the copying machine when the key $80_1$ for "Date" is depressed in the display window 80*n* of FIG. 16B, will first be described.

After the current display (FIG. 16A) is changed to another display (FIG. 16B) in step ST7, an operator depresses the key $80_1$ for "Date" (step ST8). In response to this, the display window $80_n$ (FIG. 16B) is switched to a display shown in FIG. 16C (step ST9). The operator sees a message in the display window 80*n*, and enters a desired date with ten keys 80*b* on the operation panel 80. The figures of the entered data is displayed on the window 80*n* as indicated by a broken line, while at the same time the date data is stored into the memory 148. Then, if he pushes the key $80_4$ for "Confirmation", a message stating "Designate a writing location by the spot light source" as shown in FIG. 16D (steps ST10, ST11 and ST12).

Figure 17:
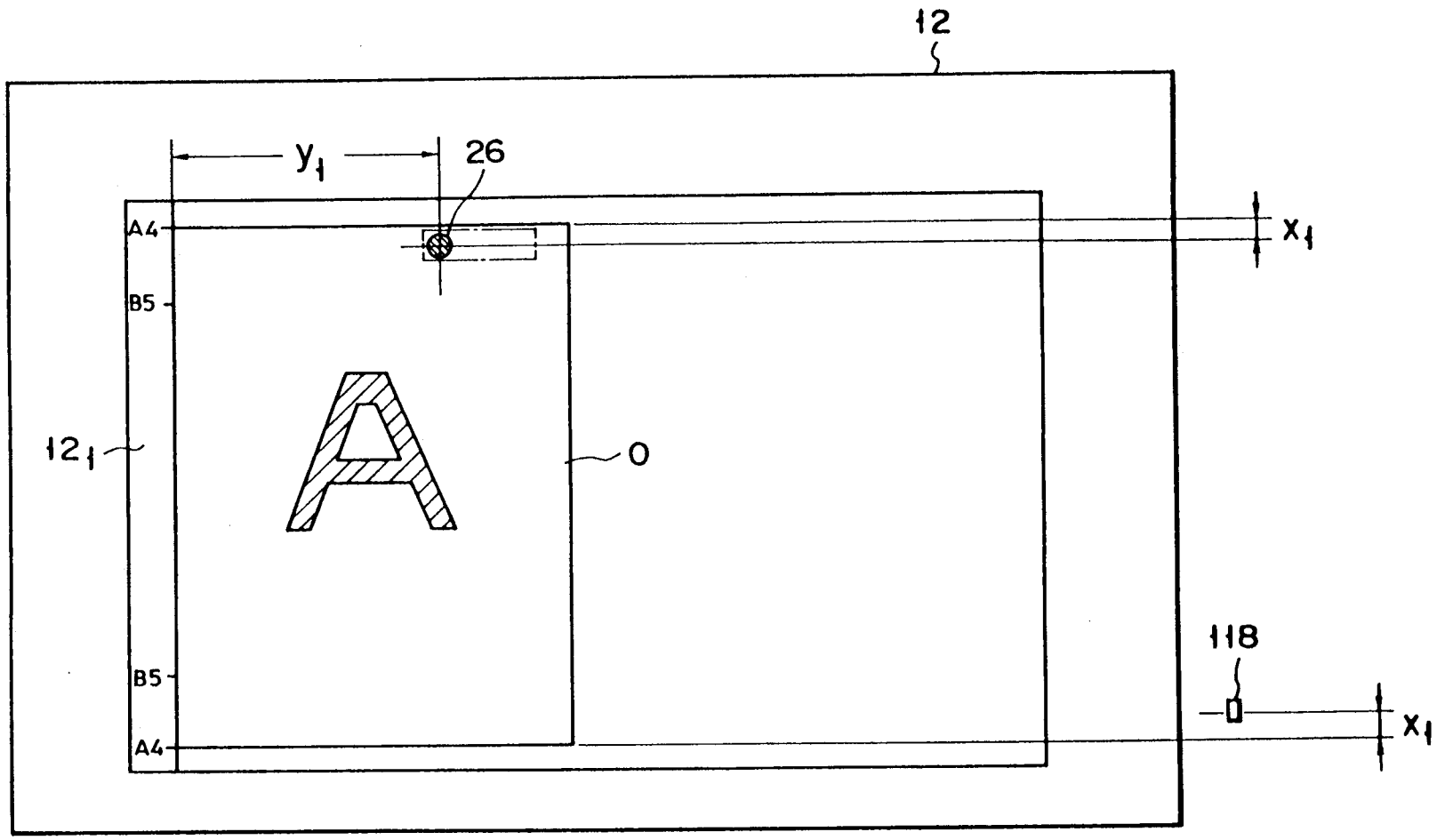
FIG. 17 is a plan view showing how a spot light indicates a write location on an original image.

The operator reads the message, and designates a desired write location by using the movement key 80*o* on the operation panel 80. With the operation of the key, the spot light source 26 is moved and hence a spot light moves. To be more specific, as shown in FIG. 17, an original O is set on the table 12, with its surface bearing an image facing upward, and the movement 80*o* is operated. In response to the key operation, the key stepping motors 86 and 94 are driven by the motor driver 150. With rotation of the motors 86 and 94, the first carriage 22 and the spot light source 26 are moved and hence the spot light source 26 moves in the x- and y-directions (FIG. 4). When the spot light source 26 reaches a write start position ($x_1$, $Y_1$ in this instance), the key $80_4$ for "Confirmation" or the location designation key 80*t* is operated (steps ST13 and ST14). The location is stored as a start position into the memory 148. Then, the motor driver 150 drives the stepping motor 110 to move the write unit 74 to a position ($x_1$) as shown in FIG. 17 (step ST15).

After the write start position is designated, he turns the original over and places it on the table 12, and the start key 80*a* is operated (steps ST16 and ST17). When the exposure/scanning position on the original approaches to the designated start position ($Y_1$), the LED driver 156 energizes all the LED elements $118_1$ of the LED array 118 to light on them at time $t_1$ (step ST18). After the LED array 118 is lit on and $\Delta t_1$ elapses, viz., at time $t_3$, the solenoid 134 is energized by the solenoid driver 154 and the shutter 122 is placed in the incident light Bi (step ST19). At time $t_4$, the elements of the LED array 118 are selectively energized in accordance with the write data, and are lit on (step ST20).

The character generator 146 sequentially generates character patterns representing the entered date data. The image data of the character patterns are transferred for each column data to the LED array 118 by the LED driver 156 in successive order. Receiving the one column image data, the LED elements $118_1$ of the linear array moving in the main scanning direction are selectively and successively lit on, so that the toner is left in the portion of the drum surface corresponding to the elements remaining lit off, and finally the left toner is configured resembling the character patterns.

After the date data is written by the LED array 118, the solenoid 134 is de-energized at time $t_5$ by the solenoid driver 154. At this time, the shutter 122 starts to swing away from the incident light Bi region (step ST21), and at time $t_6$, the swing of the shutter 122 is completed. Time $\Delta t_2$ elapses, and at time $t_2$, the LED array 118 is lit on by the LED driver 156 (step ST22).

The data written during the copying of the original image is developed by the developing unit 40, and transferred onto a recording paper by the transfer charger 54. The original image and the date on the recording paper are fixed by the heat roller 60 of the fixing unit, and discharged into the exit tray 64. At this point, the copying operation ends and the display in the display window 80*n* is returned to the initial display of FIG. 16A (steps ST23 to ST1).

Figure 18:
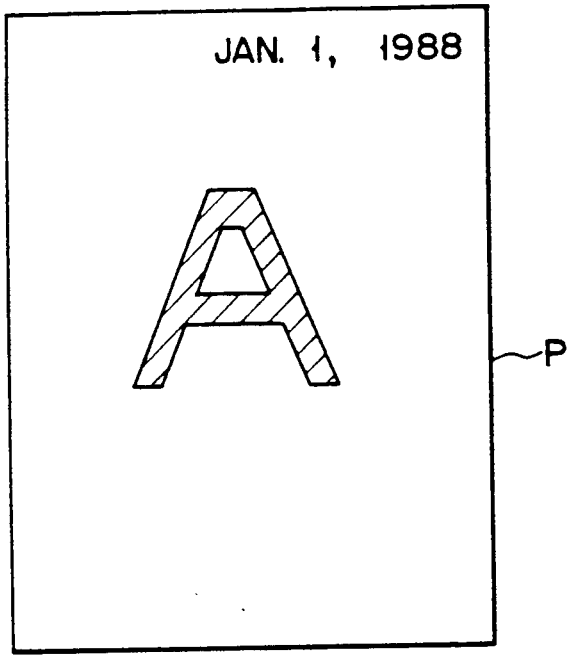
FIG. 18 is a plan view showing a copied image bearing a date written in the location indicated by a spot light, which corresponds to an original image.

The resultant images copied on the recording paper P is shown in FIG. 18. As shown, the image "A" on the original O is copied in place, and the date "January 1, 1988" is located at the location designated by the spot light source 26.

Next, how character data is written will be described.

Figure 16A:
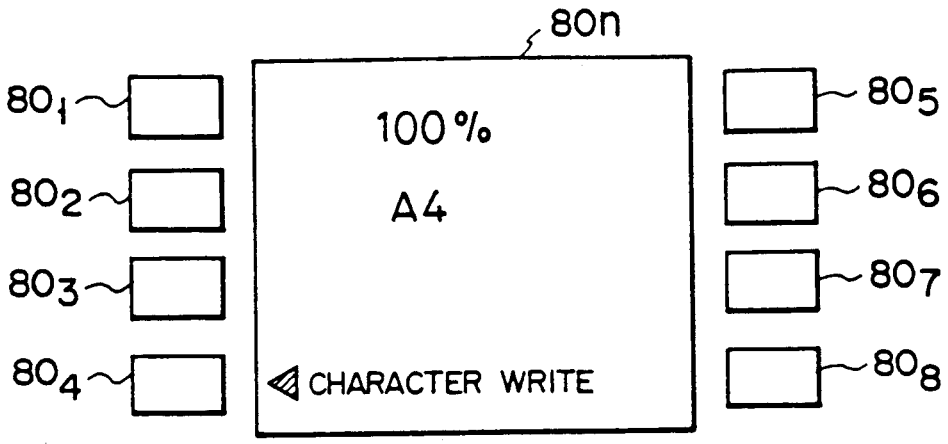
FIGS. 16A through 16G are views showing various displays presented by a display window on an operational panel of the image forming apparatus.
Figure 16B:
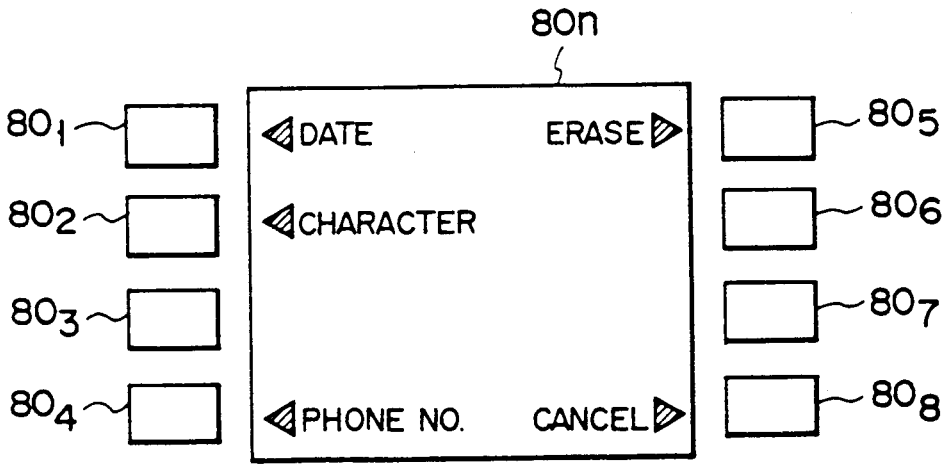
Figure 16C:
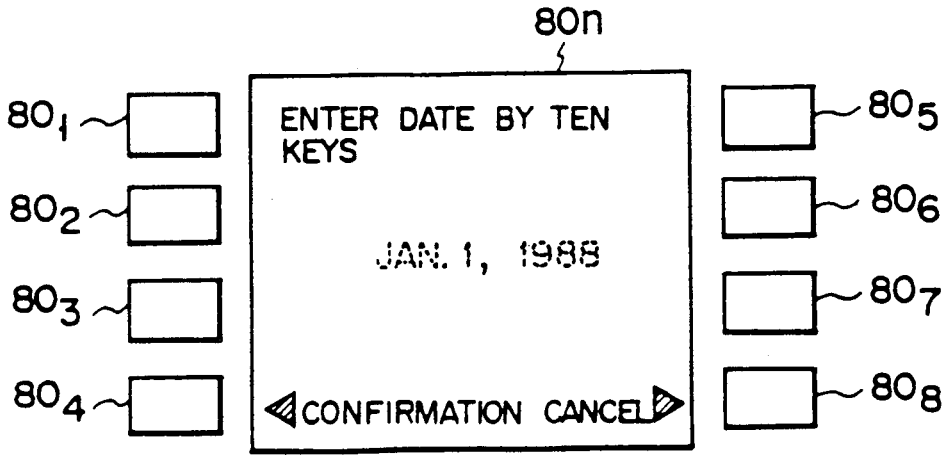
Figure 16D:
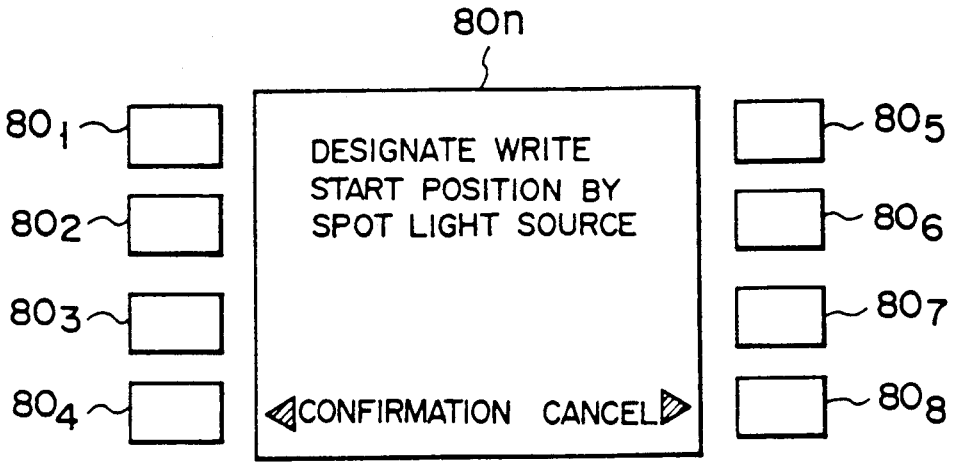
Figure 16E:
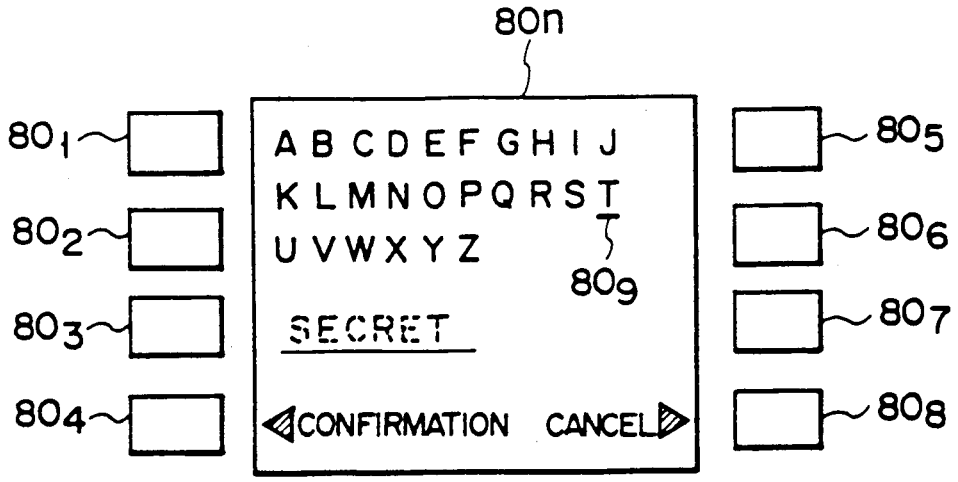

In the display of FIG. 16B, the key $80_2$ associated with "Character" is depressed (step ST24), and then the display of FIG. 16B is switched to the display of FIG. 16E (step ST25). The display window 80*n* of FIG. 16E contains alphabets A, B . . . , Z, a cursor $80_9$, "Confirmation", and "Cancel". The cursor $80_9$ is moved by the movement key 80*o*. To enter characters, the cursor $80_9$ is moved under a desired character and the designation key 80*t* is operated. This sequence is repeated for the number of desired characters. The designated characters are displayed as indicated by a broken line. In this instance, these characters are "SECRET". Then, the key $80_4$ for "Confirmation" is depressed, and the display window 80*n* is switched as shown in FIG. 16D. In this display, a write location is designated as in the previous case (steps ST12 to ST15), and the start key 80*a* is operated (step ST16). The character generator 146 then generates character patterns corresponding to the entered characters. The data of the character patterns is supplied through the LED driver 156 to the LED array 118. The elements of the LED array 118 are selectively lit on in accordance with the character pattern data, so that the input operation of the designated characters is performed with progression of the copying operation (steps ST17 to ST23).

The writing of a telephone number will be described. The writing operation is substantially equal to the operation for each of the "Date" and "Character" as already mentioned.

Figure 16F:
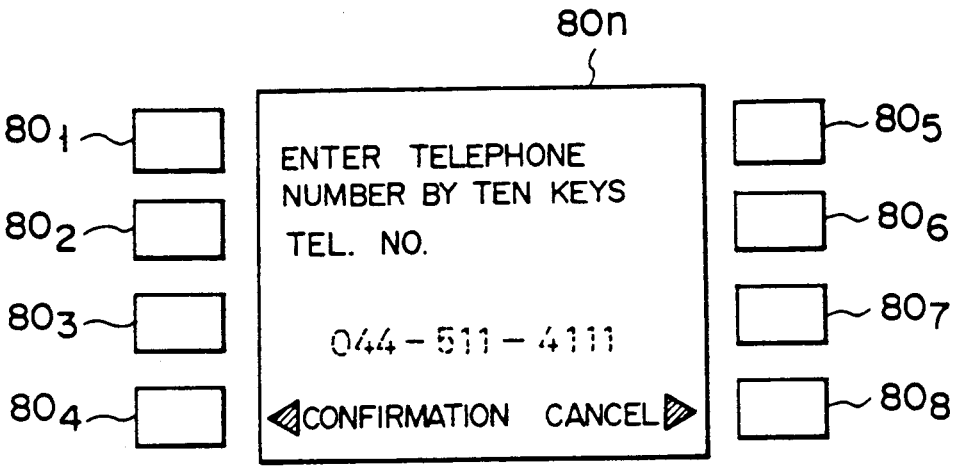
Figure 16G:
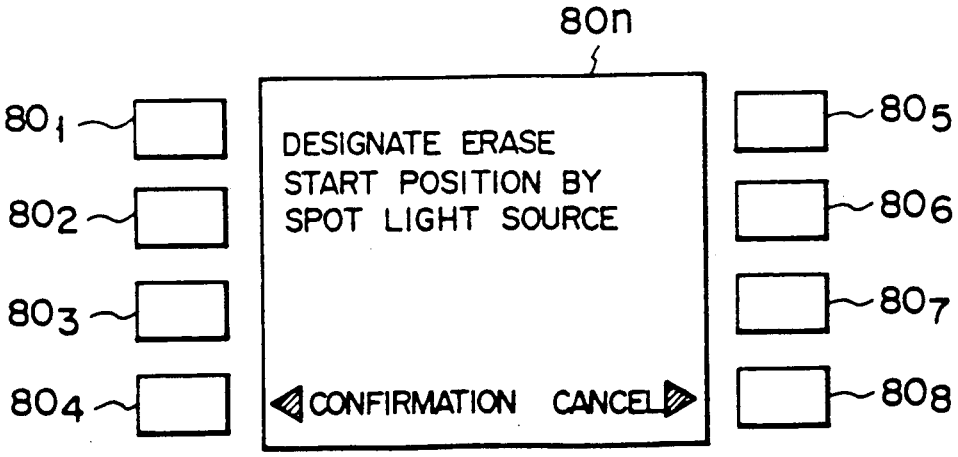
Figure 19:
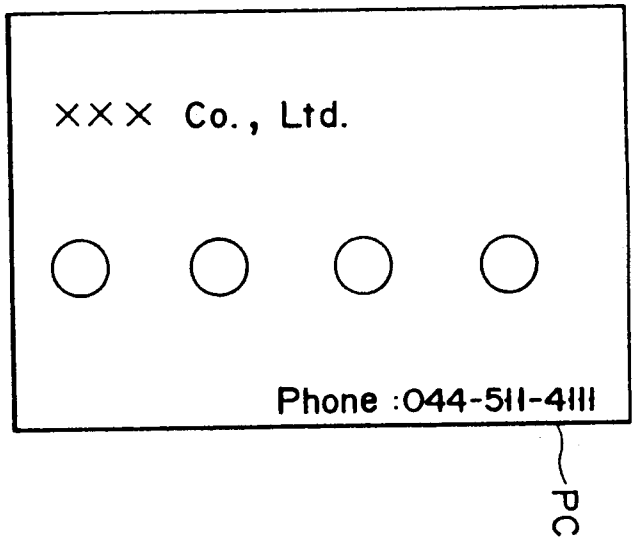
FIG. 19 is a plan view showing a copied calling card bearing a telephone number written on the location designated by a spot light, which the calling card corresponds to the original image.

In the display of FIG. 16B, when the "Phone No." key $80_4$ is operated (step ST28), a display of FIG. 16F is set up in the display window 80*n* (step ST29). The window 80*n* displays a message stating "Enter a telephone number by ten keys", "Confirmation", and "Cancel". In this display, an operator enters a telephone number by using ten keys 80*b*. The telephone number is displayed "044-511-4111" as indicated by a broken line. Then, he operates the "Confirmation" key $80_4$ (steps ST30 and ST31), so that the current display is changed to the display of FIG. 16D, that is for designating a write location. In this display, he designates a desired write location in the way as already stated (steps ST12 to ST15), and depresses the start key 80*a* (step ST16). Then, a telephone number corresponding to the entered code data is written into the designated location, while the copying operation progresses (step ST17 to ST23). In this case, the entered telephone number is converted into corresponding pattern data by the character generator 146. The generated pattern data is supplied to the LED array 118 through the LED driver 156. The elements of the LED array 118 are lit on in accordance with the received pattern data. The telephone number is written on the calling card Pc, as shown in FIG. 19.

How to erase a part of an original image by using a copying machine according to the present invention will be described.

To effect this, in the display of FIG. 16B, the "Erase" key $80_5$ is operated (step ST32). The current display is changed to a display of FIG. 16G (step ST33). A message "Designate an erasure start position by the spot light source" is presented, together with "Confirmation" and "Cancel". In this display, the spot light source 26 is moved to a desired location, and the location designation key 80*t* or the "Confirmation" key $80_4$ is operated (steps ST13 and ST14). Then, the writing unit 74 is moved to the designated location (step ST15). Further, the start key 80*a* is operated (step ST16). With progression of the copying operation, all the elements $118_1$ of the LED array 118 are turned on from the erasure start position, to discharge the charges (erase the original image) on that portion of the drum surface. The copying operation ends and the LED array 118 is also turned off.

Figure 20:
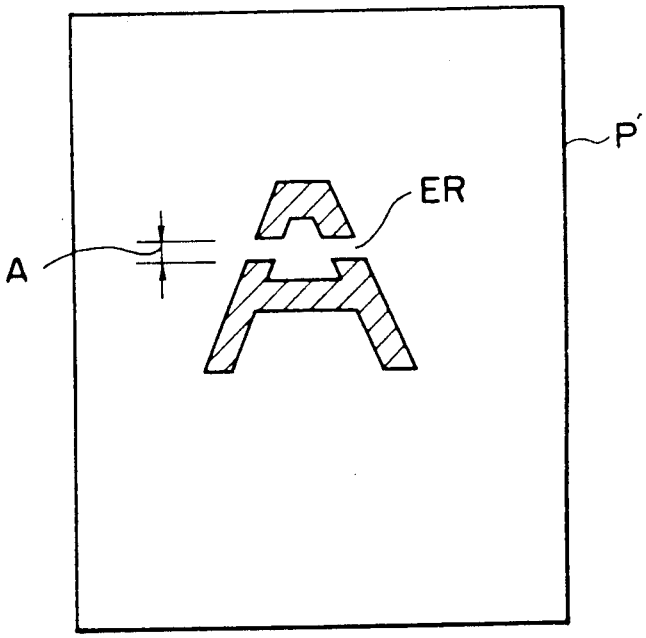
FIG. 20 is a plan view showing a copied image whose image part in a location indicated by a spot light is erased.

The resultant image on a recording paper P' is shown in FIG. 20. As shown, a portion ER in the original image "A" is erased, which is designated by the spot light source 26, and has a width equal to the width A of the LED array 118.

In the display of FIG. 16B (step ST7), when the "Cancel" key $80_8$ is operated (step ST34), the display is returned to the initial display of FIG. 16A, as in the "Cancel" key operations in other steps.

As seen from the foregoing description, in the present embodiment, the writing unit 74 is provided in the vicinity of the photoconductive drum 36. The width of the writing unit 74 is smaller than half of the maximum copy width of the photoconductive drum 36. Additional information such as date, and telephone number, together with an original image data, is written into a recording paper by using the writing unit 74. In other words, such additional information can be written by using an ordinary copying machine, not using a digital copying machine which is expensive. In this respect, the cost to manufacture is reduced.

Further, the additional information and the original image data can be copied through one copying operation. This indicates that the copying operation is speedy.

The shutter 122 provided on the side wall of the writing unit 74 is swingable to and from the incident light Bi region. When the shutter 122 is swung to the incident light Bi region, it shuts off a part of the incident light Bi. The additional information is written into this shut-off area. Therefore, a reliable writing of the additional information is possible.

The length A of the LED array 118 extending in the longitudinal direction of the photoconductive drum 36 is longer than the width B of the shutter 122 in the same direction. This feature eliminates the problem of the residual black linear images on both sides of the shutter 122 in the above direction.

The width B of the shutter 122 is set to be longer than the width C of a figure as formed by the additional data. Because of this, the additional data is always written perfectly.

In the case where character data is written, the LED elements of array 118 are turned on before shutter 122 is opened and are turned off after shutter 122 is closed. Therefore, the residual black linear images corresponding to the swinging end of shutter 122 can be reliably eliminated.

The rack and pinion mechanism including the pinion 126 and the rack 128 driven by the solenoid plunger 132 inside the writing unit 74 is used to drive the shutter 122. Use of this mechanism enables the size of the writing unit 74 to be reduced. The shutter 122 may be disposed in close to the surface of the photoconductive drum 36. Therefore, when the incident light Bi is partially shut off by the shutter 122, the incident light Bi may be sharply shut off with the minimized adverse effect by the reflection of the incident light Bi.

The writing unit 74 is movable in the longitudinal direction of the photoconductive drum 36. This feature allows the additional information to be written into a desired location in the original image.

The write unit 74 may be positioned at a desired location on the original O placed on the table 12 by the spot light source 26. The designation of the write location is easy and exact.

In an erase mode, a desired portion in an original image may be designated by the spot light source 26 and erased by the writing unit 74 simultaneously with recording of original image. Therefore, to erase a small portion of the image, there is no need for the erasure array 72.

We claim:

1. An image forming apparatus for forming an image identical to an original image and an additional pattern image, both on a moving image carrier, having means for forming the image corresponding to the original image of the image carrier, and means for making visible the image and the additional pattern image which are formed on the image carrier, comprising:

means for entering data representing the specific pattern image;

means for generating pattern data corresponding to the data entered by said entering means; and means for forming the pattern image corresponding to the pattern data generated by the pattern data generating means on the image carrier;

wherein said additional pattern image forming means is provided along a surface of the image carrier between an exposure section at which the image corresponding to the original image is formed on the image carrier and a developer at which both the image and the additional image are developed; and said additional pattern image forming means is provided with shutter means for shutting off an incident light supplied to the exposure section, said shutter means having a width narrower than an illumination range of said additional pattern image forming means, measured in a direction normal to a direction in which the image carrier moves.

2. An apparatus according to claim 1, wherein said pattern image forming means includes a LED array consisting of a plurality of LEDs.

3. An apparatus according to claim 2, wherein said shutter means has a longitudinal direction that is coincident with the direction, and said shutter means has a width which is narrower than an illumination range of said LED array as viewed in the direction, but wider than a range extending in the direction, and within which said LED array can write the pattern data.

4. An apparatus according to claim 4, wherein said pattern image forming means has a writing unit containing said shutter means and said LED array.

5. An apparatus according to claim 4, wherein said LED array lights up prior to the opening of said shutter means, and switches off after the closing of said shutter means.

6. An apparatus according to claim 4, wherein said pattern image forming means is arranged such that said shutter means is located upstream of said LED array as viewed in the image carrier moving direction.

7. An apparatus according to claim 3, wherein said shutter means is movable about an axis, situated in the vicinity of the side wall of said writing unit, to shut off the incident light.

8. An apparatus according to claim 3, further comprising means for designating a location at which the data is to be written by said entering means.

9. An apparatus according to claim 8, wherein said designating means comprises a spot light source.

10. An electronic copying machine comprising;

means for entering desired write data;

means for generating pattern data corresponding to the write data entered by said entering means;

means for optically scanning an original image in a first direction and for forming an image corresponding to the original image on an image carrier;

means, movable along said image carrier in a second direction orthogonal to the first direction, for writing the pattern data generated by said pattern data generating means at a location on said image carrier;

means for developing the image and the pattern data which are formed on said image carrier;

means for transferring onto a recording medium the image and the pattern data developed by said developing means; and means for fixing the image and the pattern data transferred onto said recording medium by said transfer means;

wherein said pattern data writing means is provided along the image carrier between an exposure section at which the image corresponding to the original image is formed on the image carrier and said developing mean; and said pattern data writing means includes shutter means for shutting off an incident light supplied to the image carrier at the exposure section corresponding to the original image and having a width which is narrower than an illumination range of said pattern data generating means in the first direction.

11. A machine according to claim 10, wherein said writing means has a shutter means to shut off, in response to a write command from said entering means a light from said scanning means, incident on said image carrier in order to write the pattern data from the pattern data generating means.

12. A machine according to claim 11, wherein said writing means includes a LED array consisting of a plurality of LEDs.

13. A machine according to claim 12, wherein said shutter means has a longitudinal direction that is coincident with the second direction, and said shutter means has a width which is narrower than an illumination range of said LED array as viewed in the second direction, but is wider than a range extending in the second direction, and within which said LED array can write the pattern data.

14. The apparatus according to claim 13, wherein said writing means has a writing unit containing said shutter means and said LED array.

15. A machine according to claim 14, wherein said LED array lights up prior to the opening of said shutter means, and switches off after the closing of said shutter means.

16. A machine according to claim 14, wherein said writing means is arranged such that said shutter means is located upstream of said LED array as viewed in the first direction.

17. A machine according to claim 14, wherein said shutter means is movable about an axis, situated in the vicinity of the side wall of said writing unit, to shut off the incident light from said scanning means.

18. A machine according to claim 13, further comprising means for designating a location at which the write data is to be written by said entering means.

19. A machine according to claim 18, wherein said designating means comprises a spot light source.

20. A method of forming an original image and desired additional image onto a recording medium, comprising the steps of:

entering desired write data;

generating pattern data corresponding to the write data entered by said entering step;

optically scanning the original image in a first direction;

forming at an exposure section on an image carrier an image corresponding to the original image scanned in said scanning step;

shielding said image carrier from a light from said original image in response to a write command of the write data at said exposure section with a width narrower than an illumination range for writing the pattern data;

writing said pattern data on said image carrier shielded in said shielding step at a downstream portion of said exposure section; and making visible the image and the pattern data which are formed on said image carrier.

21. A method according to claim 20, wherein said shielding step is accomplished by an opening/closing operation of a shutter means, and said writing step is performed by a light on/off control of a LED array consisting of a plurality of LEDs.

22. A method according to claim 21, wherein said writing step is accomplished by a writing operation of a writing unit containing said shutter means and said LED array.

23. A method according to claim 22, wherein a longitudinal direction of said shutter means is coincident with the second direction, and said shutter means has a width which is narrower than an illumination range of said LED array as viewed in the second direction, but wider than a range extending in the second direction, and within which said LED array can write the pattern data.

24. A method according to claim 20, further comprising the step of designating a location at which the write data is to be written.

* * * * *